US010691048B2

(12) United States Patent
Mochizuki

(10) Patent No.: US 10,691,048 B2
(45) Date of Patent: Jun. 23, 2020

(54) IMAGE HEATING APPARATUS AND IMAGE FORMING APPARATUS

(71) Applicant: CANON KABUSHIKI KAISHA, Tokyo (JP)

(72) Inventor: Keisuke Mochizuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/257,698

(22) Filed: Jan. 25, 2019

(65) Prior Publication Data

US 2019/0235420 A1 Aug. 1, 2019

(30) Foreign Application Priority Data

Jan. 26, 2018 (JP) ..... 2018-011778

(51) Int. Cl.
*G03G 15/20* (2006.01)
*G03G 15/00* (2006.01)

(52) U.S. Cl.
CPC ..... *G03G 15/205* (2013.01); *G03G 15/2042* (2013.01); *G03G 15/5004* (2013.01); *G03G 15/2064* (2013.01); *G03G 2215/00978* (2013.01)

(58) Field of Classification Search
CPC ..... G03G 15/205
See application file for complete search history.

(56) References Cited

U.S. PATENT DOCUMENTS 7,427,727 B2 9/2008 Koide et al.
9,069,304 B2 * 6/2015 Seshita ..... G03G 15/205
10,054,882 B2 8/2018 Nomura et al.
10,114,318 B2 10/2018 Sako et al.
2008/0292347 A1 11/2008 Koide et al.
2014/0227001 A1 * 8/2014 Kishi ..... G03G 15/2042 399/69

(Continued)

FOREIGN PATENT DOCUMENTS

JP H06-095540 A 4/1994
JP 2007-025237 A 2/2007
JP 2011-197287 A 10/2011

(Continued)

OTHER PUBLICATIONS

Extended European Search Report dated Jun. 18, 2019, issued in European Patent Application No. 19153428.8.

*Primary Examiner* — Clayton E. LaBalle
*Assistant Examiner* — Leon W Rhodes, Jr.
(74) *Attorney, Agent, or Firm* — Venable LLP

(57) ABSTRACT

A control portion determines the lengths of time required to raise a plurality of heat generating elements to prescribed start-up completion target temperatures, and when a heat generating element determined to have the longest start-up requirement time among a plurality of heat generating elements is a second heat generating element, and a heat generating element determined to have shorter start-up requirement time than that of the second heat generating element among a plurality of heat generating elements is a first heat generating element, the control portion controls power to be supplied to the first heat generating element by changing a start-up control parameter for the first heat generating element with reference to the start-up performance of the second heat generating element.

16 Claims, 11 Drawing Sheets

(56) References Cited

U.S. PATENT DOCUMENTS

| | | | |
|---|---|---|---|
| 2018/0341202 | A1 | 11/2018 | Nomura et al. |
| 2019/0049881 | A1 | 2/2019 | Sako et al. |

FOREIGN PATENT DOCUMENTS

| | | | | |
|---|---|---|---|---|
| JP | 2011-253127 | A | | 12/2011 |
| JP | 2015072443 | A | * | 4/2015 |
| WO | 2017/043020 | A1 | | 3/2017 |

* cited by examiner

FIG. 3A
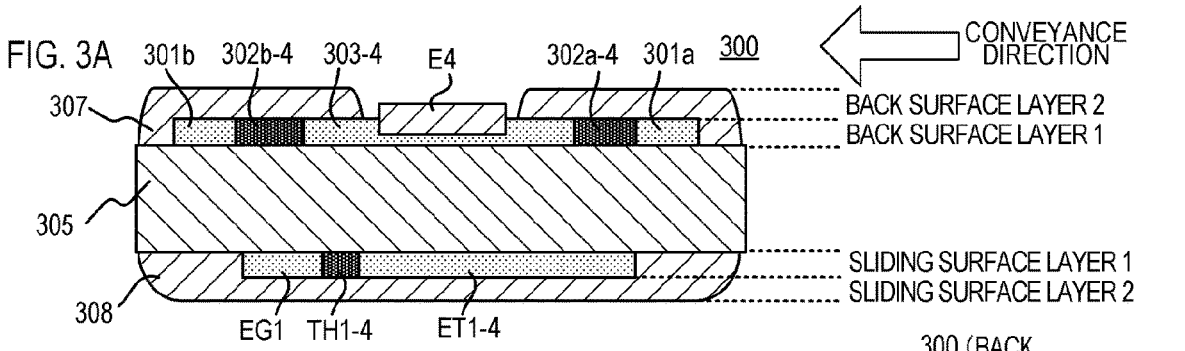
FIG. 3B
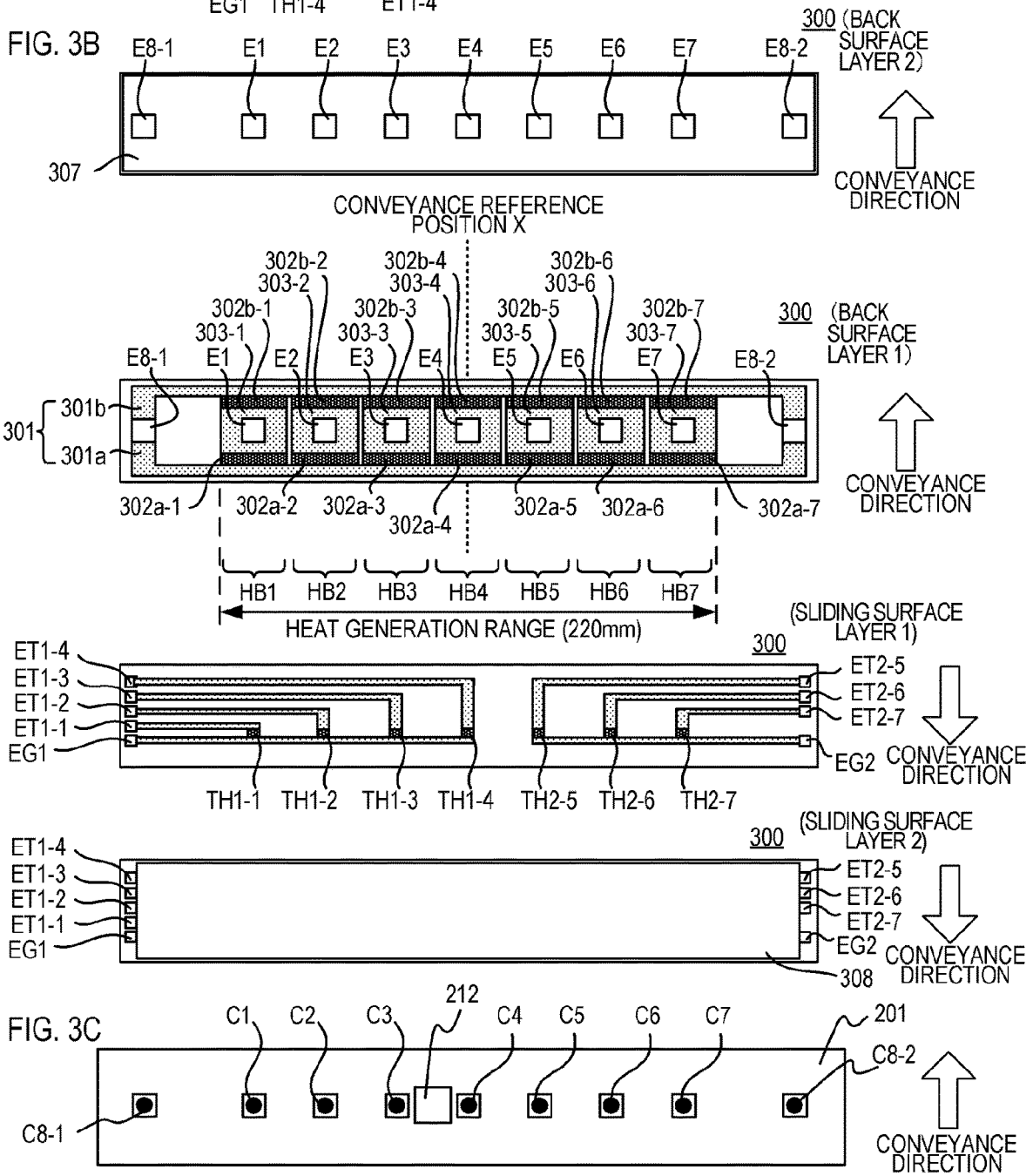
FIG. 3C

FIG. 6A THERMISTOR TH DETECTION TEMPERATURE
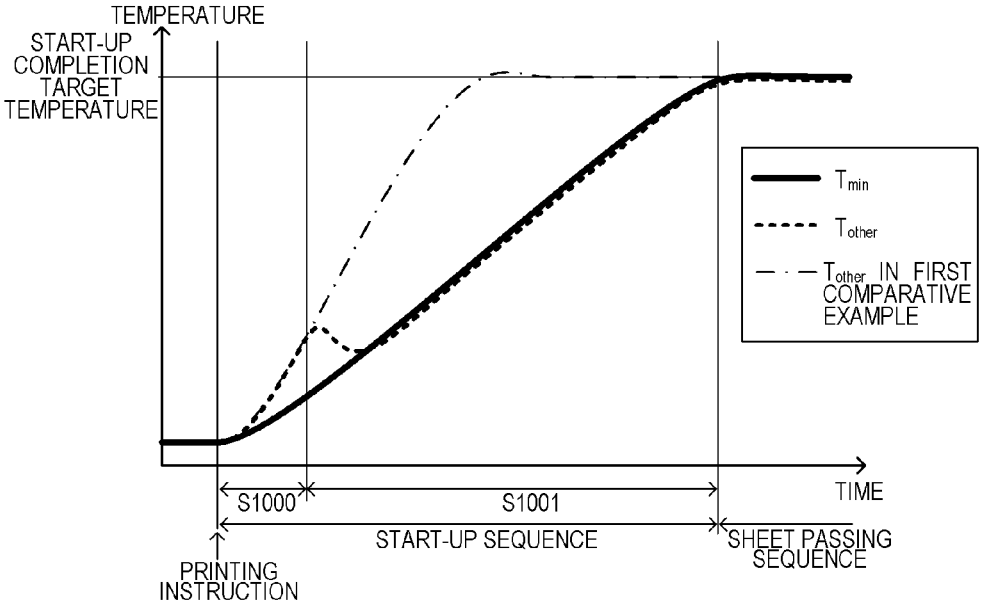
FIG. 6B CONDUCTION DUTY CYCLE
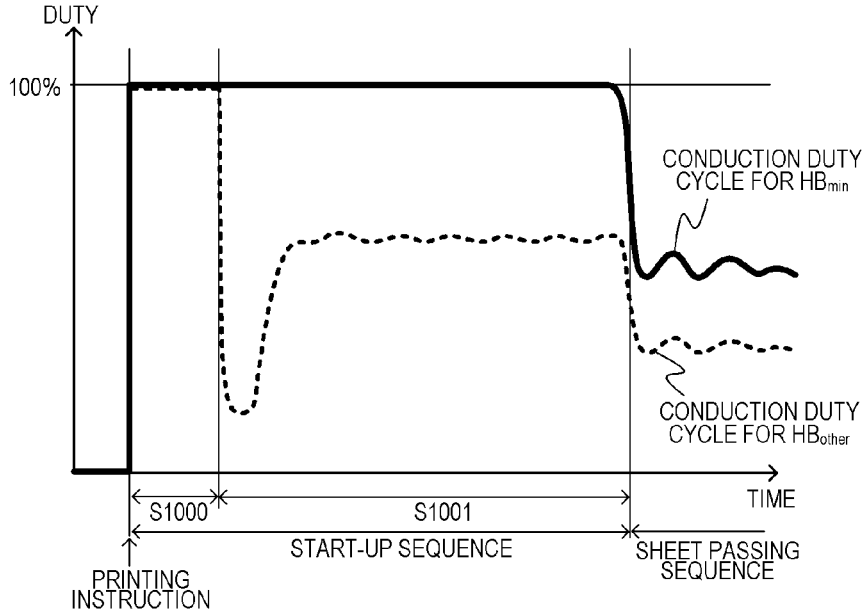

FIG. 7

| | FIRST EMBODIMENT | | FIRST COMPARATIVE EXAMPLE | |
|---|---|---|---|---|
| | PRESSURE ROLLER TEMPERATURE | HOT OFFSET | PRESSURE ROLLER TEMPERATURE | HOT OFFSET |
| $HB_1$ | 50°C | NONE | 50°C | NONE |
| $HB_2$ | 51°C | NONE | 53°C | NONE |
| $HB_3$ | 50°C | NONE | 51°C | NONE |
| $HB_4$ | 50°C | NONE | 51°C | NONE |
| $HB_5$ | 51°C | NONE | 56°C | SLIGHTLY OCCURRED |
| $HB_6$ | 51°C | NONE | 52°C | NONE |
| $HB_7$ | 51°C | NONE | 51°C | NONE |

IMAGE HEATING APPARATUS AND IMAGE FORMING APPARATUS

BACKGROUND OF THE INVENTION

Field of the Invention

The present invention relates to an image heating apparatus such as a fixing unit for use in an electro-photographic or electrostatic recording type image forming apparatus such as a copier and a printer and a gloss applying apparatus for use in such an image forming apparatus which improves the gloss value of a toner image by re-heating the toner image fixed on a recording material. The invention also relates to an image forming apparatus including the image heating apparatus.

Description of the Related Art

A method for heating image parts formed on a recording material independently from one another has been suggested in order to meet the demand for power saving in an image heating apparatus for use in an image forming apparatus such as a copier and a printer (Japanese Patent Application Publication No. H06-95540). According to the method, the heat generation range of a heater (a heating region) is divided into a plurality of heat generating blocks with respect to the lengthwise direction of the heater (in the direction orthogonal to the conveyance direction of the recording material), and the heat generating blocks are independently controlled for heat generation depending on the presence/absence of an image on a recording material. More specifically, power supplied to a heat generating block is reduced in a part with no image on the recording material (a non-image part), so that power saving can be achieved.

SUMMARY OF THE INVENTION

Here, using the image heating apparatus having the above configuration, the time until a temperature for heating the recording material is reached (hereinafter the start-up time) is short in some heat generating blocks and long in other heat generating blocks depending on the heat generating quantity of the heat generating blocks. The recording material is conveyed in synchronization with the start-up of a heat generating block with long start-up time, so that the blocks with shorter start-up time have to stand by at a higher temperature than the temperature of a heat generating block with longer start-up time while the recording material is conveyed thereto. As a result, the heat storage state varies immediately after the start-up, and an image defect such as gloss value unevenness and hot offset is observed in some cases.

It is an object of the present invention to provide a technique which can provide high power saving performance and reduce an image defect caused immediately after the start-up.

In order to achieve the above described object, an image heating apparatus according to the present invention includes: an image heating portion having a heater having a substrate and a plurality of heat generating elements arranged on the substrate in a lengthwise direction of the substrate, the image heating portion heating an image formed on a recording material using heat from the heater; a power supply control portion which controls power to be supplied to the plurality of heat generating elements independently from one another; and an acquiring portion which acquires, for each of the plurality of heat generating elements, start-up performance representing a temperature rise ratio when power is supplied thereto, wherein, in a start-up sequence for raising temperatures of the plurality of heat generating elements to respective prescribed target temperatures, the power supply control portion controls power to be supplied to the plurality of heat generating elements independently from one another on the basis of the start-up performance acquired by the acquiring portion so that the plurality of heat generating elements attain the prescribed target temperatures in the same timing.

In order to achieve the above described object, an image forming apparatus according to the present invention includes: an image forming portion which forms an image on a recording material; and the image heating apparatus as a fixing portion which fixes the image formed on the recording material to the recording material.

According to the present invention, while power saving performance is maintained, an image defect caused immediately after the start up can be reduced.

Further features of the present invention will become apparent from the following description of exemplary embodiments with reference to the attached drawings.

BRIEF DESCRIPTION OF THE DRAWINGS

FIGS. 3A to 3C are views illustrating the structure of a heater according to the first embodiment;

FIGS. 6A and 6B are graphs for illustrating a start-up sequence according to the first embodiment;

FIG. 7 is a table showing a result of comparison experiments for the first embodiment and a first comparative example;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

1. Structure of Image Forming Apparatus

Figure 1:
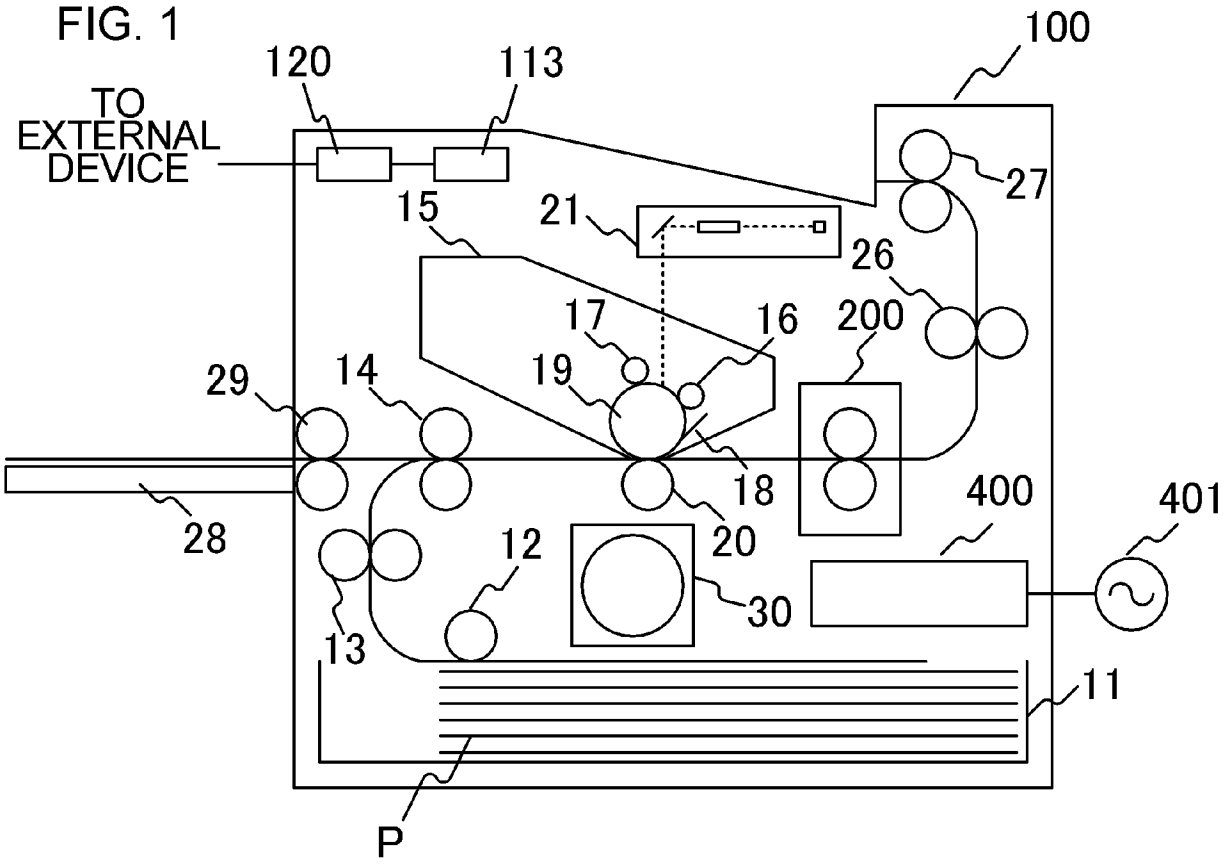
FIG. 1 is a sectional view of an image forming apparatus according to an embodiment of the present invention.

FIG. 1 is a schematic sectional view of an image forming apparatus according to an embodiment of the present invention. The present invention may be applied to an image forming apparatus such as a copier and a printer according to an electro-photographic or electro-static recording method, and an example of application to a laser printer will be described here.

An image forming apparatus 100 includes a video controller 120 and a control portion 113. The video controller 120 functions as an acquiring portion which acquires information on an image formed on a recording material and receives and processes image information and a printing instruction transmitted from an external device such as a personal computer. The control portion 113 is connected with the video controller 120 and controls various components of the image forming apparatus 100 in response to an instruction from the video controller 120. The control portion 113 is configured to control an estimating portion which estimates various kinds of start-up performance or an acquiring portion which acquires various kinds of start-up performance in temperature control of a heater which will be described and the control portion is a main component in the control. Image forming is carried out by the following operation when the video controller 120 receives a printing instruction from an external device.

When a printing signal is generated, a scanner unit 21 emits a laser beam modulated according to image information, and a photosensitive drum 19 charged to a prescribed polarity has its surface scanned by a charging roller 16. In this manner, an electrostatic latent image is formed on the photosensitive drum 19. As toner is supplied from a developing roller 17 to the electrostatic latent image, the electrostatic latent image on the photosensitive drum 19 is developed as a toner image. Meanwhile, sheets of recording material (recording sheets) P stacked in a sheet-feeding cassette 11 are fed on a one-sheet-basis by a pickup roller 12 and conveyed toward a pair of resist rollers 14 by a pair of conveyance rollers 13. The recording material P is then conveyed to a transfer position from the pair of resist rollers 14 in the timing in which the toner image on the photosensitive drum 19 reaches the transfer position formed by the photosensitive drum 19 and the transfer roller 20. The toner image on the photosensitive drum 19 is transferred onto the recording material P as the recording material P passes the transfer position. Then, the recording material P is heated by a fixing apparatus (image heating apparatus) 200 as a fixing portion (image heating portion), so that the toner image is thermally fixed on the recording material P. The recording material P carrying the fixed toner image thereon is discharged onto a tray at the upper part of the image forming apparatus 100 by a pair of conveyance rollers 26 and 27.

Note that the reference numeral 18 represents a drum cleaner for cleaning the photosensitive drum 19, and the reference numeral 28 represents a sheet-feeding tray (a manual tray) having a pair of recording member restricting plates which can have its size adjusted according to the size of the recording material P. The sheet-feeding tray 28 is provided to address the recording material P in any of other sizes. The reference numeral 29 represents the pickup roller which feeds the recording material P from the sheet-feeding tray 28, and the reference numeral 30 represents a motor which drives the fixing apparatus 200, etc. A control circuit 400 functioning as heater driving means (a power supply control portion) connected to a commercially available AC power supply 401 supplies the fixing apparatus 200 with power. The photosensitive drum 19, the charging roller 16, the scanner unit 21, the developing roller 17, and the transfer roller 20 constitute the image forming portion which forms an unfixed image on the recording material P. According to the embodiment, the developing unit which includes the photosensitive drum 19, the charging roller 16, and the developing roller 17 and a cleaning unit which includes the drum cleaner 18 are configured as a process cartridge 15 to be detachable/attachable from/to the main body of the image forming apparatus 100.

The image forming apparatus 100 according to the embodiment has a maximum sheet passing width of 216 mm in the direction orthogonal to the conveyance direction of the recording material P and can print 44.3 pages of standard sheet in the LETTER size (216 mm×279 mm) per minute at a conveyance speed of 232.5 mm/sec.

2. Structure of Fixing Device (Fixing Portion)

Figure 2:
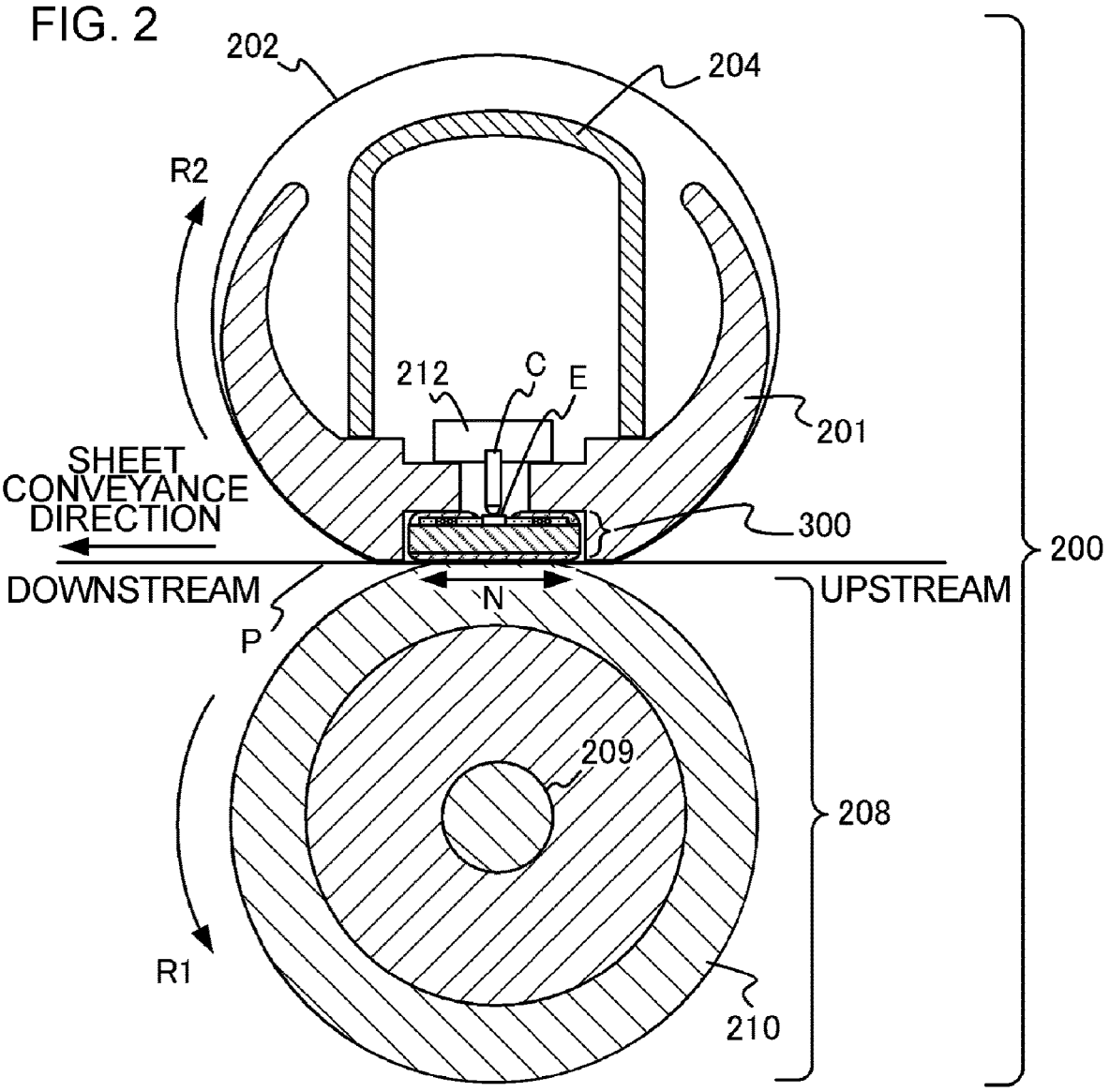
FIG. 2 is a sectional view of an image heating apparatus according to a first embodiment of the invention.

FIG. 2 is a schematic sectional view of the fixing apparatus 200 as an image heating apparatus according to the embodiment. The fixing apparatus 200 has a fixing film 202, a heater 300 in contact with the inner surface of the fixing film 202, a pressure roller 208 which forms a fixing nip portion N together with the heater 300 through the fixing film 202, and a metal stay 204.

The fixing film 202 is a multi-layer heat resisting film also referred to as an endless belt or an endless film and formed to have a tubular shape and includes a heat resisting resin such as polyimide or a metal such as stainless steel as a base layer. A releasing layer is formed by coating a surface of the fixing film 202 with a heat resisting resin with high releasability such as tetrafluoroethylene/perfluoro (alkyl vinyl ether) copolymer (PFA) in order to prevent toner from sticking or secure releasability from the recording material P. In order to improve the image quality, heat resisting rubber such as silicone rubber may be formed as an elastic layer between the base layer and the releasing layer. The pressure roller 208 has a core bar 209 of a material such as iron and aluminum and an elastic layer 210 of a material such as silicone rubber. The heater 300 is held by a heater holding member 201 of a heat resisting resin, and heating regions $A_1$ to $A_7$ (which will be detailed later) provided in the fixing nip portion N are heated to heat the fixing film 202. The heater holding member 201 also has a guiding function to guide the fixing film 202 to rotate. The heater 300 is provided with an electrode E on the opposite side (the back surface side) to the side on which the heater is in contact the inner surface of the fixing film 202, and the electrode E is supplied with power from an electric contact C. The metal stay 204 receives pressurizing force which is not shown and energizes the heater holding member 201 toward the pressure roller 208. A safety element 212 such as a thermo-switch and a temperature fuse activated to shut off power supplied to the heater 300 in response to abnormal heat generation by the heater 300 is provided to oppose the back surface side of the heater 300.

The pressure roller 208 receives motive power from a motor 30 shown in FIG. 1 and rotates in the direction of the arrow R1. The fixing film 202 follows the rotation of the pressure roller 208 to rotate in the direction of the arrow R2. The recording material P is sandwiched at the fixing nip portion N and conveyed while being provided with heat from the fixing film 202, so that the unfixed toner image on the recording material P is fixed. In order to secure the slidability of the fixing film 202 so that the film stably follows the rotation, grease with high heat resistance (not shown) is interposed between the heater 300 and the fixing film 202.

3. Structure of Heater

With reference to FIGS. 3A to 3C, the structure of the heater 300 according to the embodiment will be described. FIG. 3A is a sectional view of the heater 300, FIG. 3B is a plan view of the layers of the heater 300, FIG. 3C is a view for illustrating a method for connecting the electric contact C to the heater 300. FIG. 3B indicates a conveyance reference position X for the recording material P in the image forming apparatus 100 according to the embodiment. The conveyance reference according to the embodiment is a center reference, and the recording material P is conveyed so that its center line in a direction orthogonal to the conveyance direction matches the conveyance reference position X. FIG. 3A is a sectional view of the heater 300 taken along the conveyance reference position X.

The heater 300 includes a ceramic substrate 305, a back surface layer 1 provided on the substrate 305, a back surface layer 2 which covers the back surface layer 1, a sliding surface layer 1 provided at the surface opposite to the back surface layer 1 on the substrate 305, and a sliding surface layer 2 which covers the sliding surface layer 1.

The back surface layer 1 has a conductor 301 (301*a* and 301*b*) provided in the lengthwise direction of the heater 300. The conductor 301 is divided into the conductors 301*a* and 301*b*, and the conductor 301*b* is provided downstream in the conveyance direction of the recording material P with respect to the conductor 301*a* on the substrate. The back surface layer 1 has conductors 303 (303-1 to 303-7) provided in parallel to the conductors 301*a* and 301*b*. The conductors 303 are provided in the lengthwise direction of the heater 300 between the conductors 301*a* and 301*b*. The back surface layer 1 has heat generating elements 302*a* (302*a*-1 to 302*a*-7) and heat generating elements 302*b* (302*b*-1 to 302*b*-7) as heat generating resistors which generates heat by conduction. The heat generating elements 302*a* are provided between the conductors 301*a* and 303 and supplied with power through the conductors 301*a* and 303 to generate heat. The heat generating element 302*b* is provided between the conductors 301*b* and 303 and supplied with power through the conductors 301*b* and 303 to generate heat.

The heat generating part including the conductors 301 and 303 and the heat generating elements 302*a* and 302*b* is divided into seven heat generating blocks ($HB_1$ to $HB_7$) with respect to the lengthwise direction of the heater 300. More specifically, the heat generating element 302*a* is divided into seven regions, i.e., the heat generating elements 302*a*-1 to 302*a*-7 with respect to the lengthwise direction of the heater 300. The heat generating element 302*b* is divided into seven regions, i.e., the heat generating elements 302*b*-1 to 302*b*-7 with respect to the lengthwise direction of the heater 300. The conductor 303 is divided into seven regions, i.e., the conductors 303-1 to 303-7 corresponding to the dividing positions of the heat generating elements 302*a* and 302*b*. The amounts of power supplied to the heat generating resistors in the seven blocks ($HB_1$ to $HB_7$) are individually controlled, so that the heat generating quantity of the respective blocks are individually controlled.

The heat generation range according to the embodiment is from the left end of the heat generating block $HB_1$ to the right end of the heat generating block $HB_7$ in the figure and the total length is 220 mm. The length of each of the heat generating blocks is equally about 31 mm, while the length may be different among the blocks.

The back surface layer 1 has electrodes E (E1 to E7, E8-1 and E8-2). The electrodes E1 to E7 are provided in the regions of the conductors 303-1 to 303-7, respectively and serve to supply power to the heat generating blocks $HB_1$ to $HB_7$ through the conductors 303-1 to 303-7, respectively. The electrodes E8-1 and E8-2 are provided to be connected with the conductor 301 at the lengthwise ends of the heater 300 and serve to supply power to the heat generating blocks $HB_1$ to $HB_7$ through the conductor 301. According to the embodiment, the electrodes E8-1 and E8-2 are provided at the lengthwise ends of the heater 300 while for example only the electrode E8-1 may be provided at one end (without providing the electrode E8-2). A common electrode is used to supply power to the conductors 301*a* and 301*b*, while the conductors 301*a* and 301*b* may each be provided with an individual electrode and supplied with power.

The back surface layer 2 includes an insulating surface protection layer 307 (of glass according to the embodiment) which covers the conductors 301 and 303 and the heat generating elements 302*a* and 302*b*. The surface protection layer 307 is formed for the region except for the location of electrodes E, and electric contacts C can be connected to the electrode E from the side of the back surface layer 2 of the heater.

The sliding surface layer 1 is provided on the surface of the substrate 305 on the opposite side to the surface provided with the back surface layer 1 and has thermistors TH (TH1-1 to TH1-4 and TH2-5 to TH2-7) as detecting elements for detecting the temperatures of the heat generating blocks $HB_1$ to $HB_7$. The thermistors TH are made of a material having a PTC characteristic or an NTC characteristic (the NTC characteristic according to the embodiment) and the temperatures of all the heat generating blocks can be detected by detecting the resistance values of the thermistors.

The sliding surface layer 1 has conductors ET (ET1-1 to ET1-4 and ET2-5 to ET2-7) and conductors EG (EG1 and EG2) for passing current through the thermistors TH and detecting the resistance values. The conductors ET1-1 to ET1-4 are connected to the thermistors TH1-1 to TH1-4, respectively. The conductors ET2-5 to ET2-7 are connected to the thermistors TH2-5 to TH2-7, respectively. The conductor EG1 is connected to the four thermistors TH1-1 to TH1-4 to form a common conduction path. The conductor EG2 is connected to the three thermistors TH2-5 to TH2-7 to form a common conduction path. The conductor ET and the conductor EG are formed in the lengthwise direction of the heater 300 up to the lengthwise ends of the heater 300 and are connected with the control circuit 400 through electric contacts (not shown) at the lengthwise ends of the heater 300.

The sliding surface layer 2 is made of a slidable insulating surface protection layer 308 (glass according to the embodiment), covers the thermistors TH, the conductors ET, and the conductors EG, and secures the slidability against the inner surface of the fixing film 202. The surface protection layer 308 is formed in the region except for the lengthwise ends of the heater 300 in order to provide electric contacts to the conductors ET and the conductors EG.

Now, a method for connecting an electric contact C to each of the electrodes E will be described. FIG. 3C is a plan view of the electric contact C connected to each of the electrodes E as viewed from the side of the heater holding member 201. The heater holding member 201 is provided with through holes in positions corresponding to the electrodes E (E1 to E7 and E8-1 and E8-2). The electric contacts C (C1 to C7 and C8-1 and C8-2) are electrically connected to the electrodes E (E1 to E7 and E8-1 and E8-2) by energizing using a spring or welding in the positions of the through holes. The electric contacts C are connected to the control circuit 400 for the heater 300, which will be described, through a conductive material (not shown) provided between the metal stay 204 and the heater holding member 201.

4. Structure of Heater Control Circuit

Figure 4:
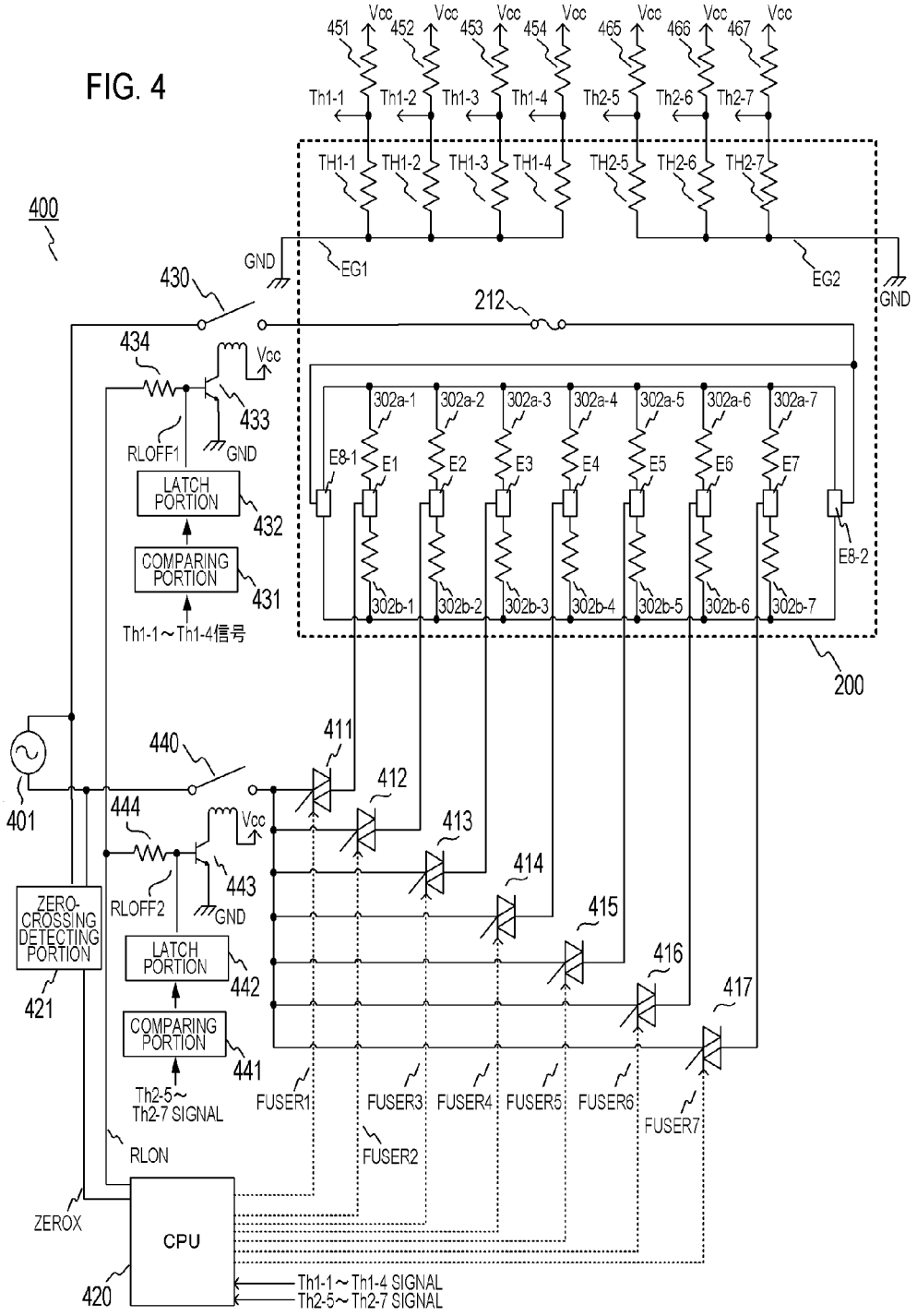
FIG. 4 is a diagram of a heater control circuit according to the first embodiment.

FIG. 4 is a circuit diagram of the control circuit 400 for the heater 300 according to the first embodiment. The reference numeral 401 represents a commercially available AC power supply connected to the image forming apparatus 100. Power control for the heater 300 is carried out by conducting/shutting off triacs 411 to 417. The triacs 411 to 417 operate in response to FUSER1 to FUSER7 signals, respectively from a CPU 420. A driving circuit for the triacs 411 to 417 is not shown. The control circuit 400 for the heater 300 has a circuit configuration which allows the seven heat generating blocks $HB_1$ to $HB_7$ to be independently controlled by the seven triacs 411 to 417. As the triacs 411 to 417 are controlled independently, power supplied to the plurality of heat generating elements can be controlled independently, so that the plurality of heating regions obtained by division in the lengthwise direction can be heated independently from one another. A zero-crossing detecting portion 421 is a circuit which detects a zero-crossing of the AC power supply 401 and outputs a ZEROX signal to the CPU 420. The ZEROX signal is used to detect timing for phase control or wavenumber control for the triacs 411 to 417.

A method for detecting the temperature of the heater 300 will be described. The temperature of the heater 300 is detected by the thermistors TH (TH1-1 to TH1-4 and TH2-5 to TH2-7). Fractional voltages across the thermistors TH1-1 to TH1-4 and resistors 451 to 454 are obtained as signals Th1-1 to Th1-4 by the CPU 420, and the signals Th1-1 to Th1-4 are converted into temperatures by the CPU 420. Similarly, fractional voltages across the thermistors TH2-5 to TH2-7 and resistors 465 to 467 are obtained as signals Th2-5 to Th2-7 by the CPU 420, and the signals Th2-5 to Th2-7 are converted into temperatures by the CPU 420.

During internal processing by the CPU 420, power to be supplied is calculated by PI control (proportional integral control) on the basis of a control target temperature $TGT_i$ for each of the heat generating blocks and temperatures detected by the thermistors. Then, the power is converted into a phase angle (phase control) corresponding to the power or a wavenumber (wavenumber control) control level (a duty cycle) and the triacs 411 to 417 are controlled on the control conditions.

Relays 430 and 440 are used as power shutting off means for the heater 300 when the temperature of the heater 300 is excessively raised. The circuit operation of the relays 430 and 440 will be described. When an RLON signal attains a high state, a transistor 433 is turned on, and current is passed to the secondary side coil of the relay 430 from the power supply voltage Vcc, which turns on the primary side contact of the relay 430. When the RLON signal attains a low state, the transistor 433 is turned off, and current passed to the secondary side coil of the relay 430 from the power supply voltage Vcc is shut off, which turns off the primary side contact of the relay 430. Similarly, when the RLON signal attains a high state, the transistor 443 is turned on, and current is passed to the secondary side coil of the relay 440 from the power supply voltage Vcc, which turns on the primary side contact of the relay 440. When the RLON signal attains a low state, the transistor 443 is turned off, current passed to the secondary side coil of the relay 440 from the power supply voltage Vcc is shut off, which turns off the primary side contact of the relay 440. Note that resistors 434 and 444 are current limiting resistors.

The operation of the safety circuit using the relays 430 and 440 will be described. When any one of the temperatures detected by the thermistors TH1-1 to TH1-4 exceeds a value predetermined therefor, a comparing portion 431 activates a latch portion 432, and the latch portion 432 latches an RLOFF1 signal in a low state. When the RLOFF1 signal attains a low state, and the CPU 420 makes the RLON signal attain a high state, the transistor 433 is kept in an off state, so that the relay 430 can be kept in an off state (a safe state). Note that the latch portion 432 allows the RLOFF1 signal to be output in an open state in a non-latch state. Similarly, when any one of the temperatures detected by the thermistors TH2-5 to TH2-7 exceeds a value predetermined therefor, a comparing portion 441 causes the latch portion 442 to operate and latch an RLOFF2 signal in a low state. When the RLOFF2 signal attains a low state, and even if the CPU 420 makes the RLON signal attain a high state, the transistor 443 is kept in an off state, so that the relay 440 can be kept in an off state (a safe state). Similarly, the latch portion 442 allows the RLOFF2 signal to be output in an open state in a non-latch state.

5. Heater Control According to Heating Region and Image Information

Figure 5:
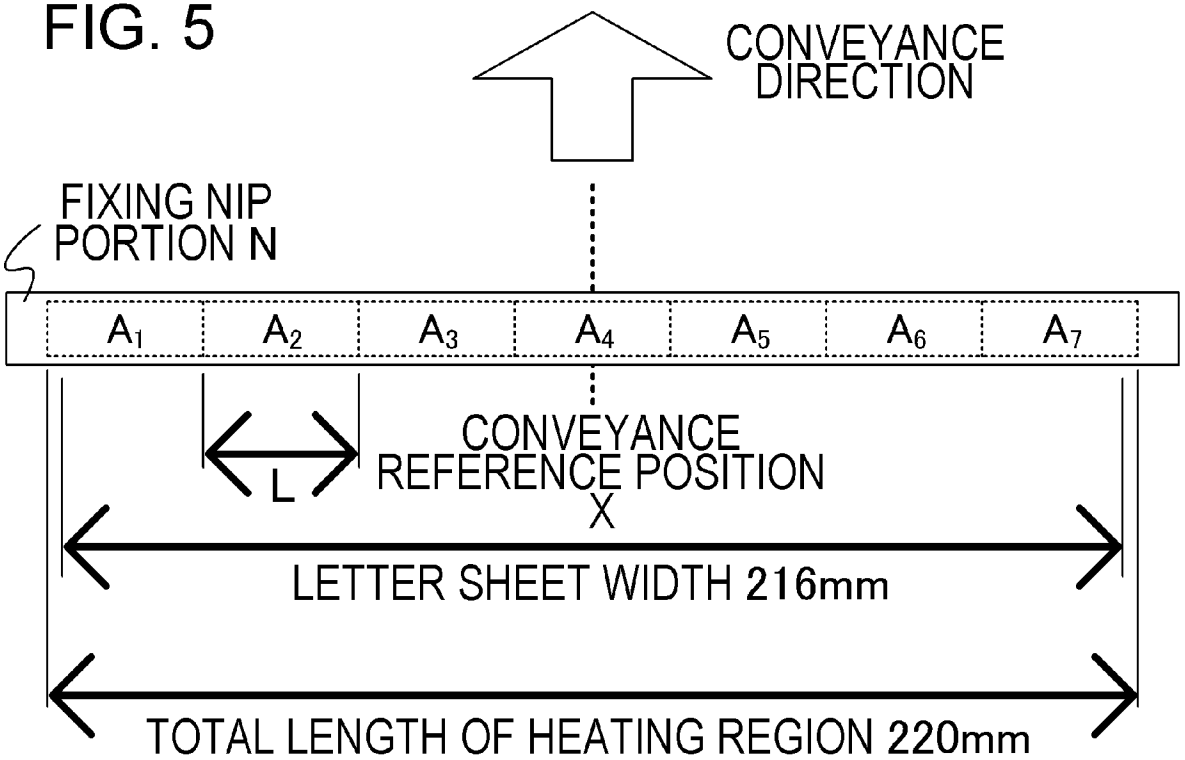
FIG. 5 is a view for illustrating heating regions according to the first embodiment.

FIG. 5 is a view of the heating regions $A_1$ to $A_7$ according to the embodiment shown in comparison with the width of the LETTER size sheet. The heating regions $A_1$ to $A_7$ are provided in positions corresponding to the heat generating blocks $HB_1$ to $HB_7$ in the fixing nip portion N, and the heating region $A_i$ (i=1 to 7) is heated as the heat generating block $HB_i$ (i=1 to 7) generates heat. The heating regions $A_1$ to $A_7$ have a total length of 220 mm, and the regions are obtained by equally dividing the length into seven (L=31.4 mm).

The image forming apparatus according to the embodiment changes a heat generating quantity for each of the heat generating blocks $HB_i$ according to image data (image information) transmitted from an external device (not shown) such as a host computer. For example, it has been known that an image with a low print percentage having toner particles coarsely dispersed such as a half-tone image requires a higher heat value to have toner fixed. In such a case, a higher target temperature is set for a heat generating block $HB_i$ which heats a heating region $A_i$ corresponding to the low print percentage image. Conversely, a smaller heat value is necessary to fix a high print percentage image having toner particles densely arranged, and therefore a lower target value is set for a heat generating block $HB_i$ which heats a heating region $A_i$ corresponding to the high printing percentage image. In this way, the heat generating quantity is controlled for each of the heat generating blocks $HB_i$ according to the image information, so that excessive heating can be avoided, and power can be saved.

6. Method for Start-up Control

Then, a method for controlling heating by the heater in a start-up sequence of the fixing apparatus 200 will be described with reference to FIGS. 6A and 6B. The start-up sequence is carried out to warm the fixing apparatus 200 to an appropriate temperature (hereinafter referred to as a start-up completion target temperature) for heating a recording material P and a toner image on the recording material P.

FIG. 6A shows an example of the transition of the temperatures of heat generating blocks detected by the thermistors TH. The solid line indicates the temperature $T_{min}$ of the heat generating block determined to require the longest start-up time (hereinafter as $HB_{min}$) according to the following method among the heat generating blocks $HB_i$ (i=1 to 7). The dotted line indicates the temperature $T_{other}$ of the heat generating blocks $HB_i$ (i=1 to 7) other than the heat generating block $HB_{min}$ (hereinafter $HB_{other}$) among the heat generating blocks $HB_i$ (i=1 to 7). FIG. 6B shows an example of a duty cycle transition when power is supplied to the heat generating block $HB_i$ (i=1 to 7). The solid line represents the conduction duty cycle of the heat generating block $HB_{min}$ and the dotted line is the conduction duty cycle of the heat generating block $HB_{other}$. While there are more than one heat generating blocks $HB_{other}$, the temperature and the conduction duty cycle of one of the blocks are indicated as typical values.

As shown in FIGS. 6A and 6B, the start-up sequence according to the embodiment is divided into a section (S1000) for supplying power to the heat generating block $HB_i$ (i=1 to 7) with a fixed duty cycle and a start-up section (S1001) by PI control.

In the fixed duty cycle section S1000 (the first section), the length of the start-up requirement time for the heat generating blocks $HB_i$ (1 to 7) is determined as follows. When the image forming apparatus 100 receives a printing instruction from an external device, the CPU 420 starts to supply power with the same fixed duty cycle to the heat generating blocks $HB_i$ (i=1 to 7). According to the embodiment, the duty cycle is 100% (so-called full conduction). At the time, variations in the resistance values of the heat generating resistors in the heat generating blocks $HB_i$ cause variations in the power (or the heat generating quantity) of the heat generating blocks $HB_i$. As the resistance value is smaller, the power increases and thus the heat generating quantity increases, while as the resistance value is greater, the power is reduced and thus the heat generating quantity is reduced. As the heat generating quantity is smaller, the temperature is less easily raised, so that longer start-up time is required. Therefore, according to the embodiment, in timing a prescribed period after the start of supply of power with the fixed duty cycle, the temperatures of the heat generating blocks $HB_i$ are detected by the thermistors TH. Then, it is determined that the heat generating block $HB_i$ with the lowest temperature that requires the longest start-up time is the heat generating block $HB_{min}$. When the heat generating block $HB_{min}$ which requires the longest start-up time is determined, the start-up sequence proceeds to the PI control section S1001.

In the PI control section S1001 (the second section), conduction control to the heat generating block $HB_{min}$ which requires the longest start-up time is carried out by PI control so that the temperature $T_{min}$ of the heat generating block $HB_{min}$ is approximated to the start-up completion target temperature. When the temperature $T_{min}$ is sufficiently lower than the start-up completion target temperature, power is supplied with a duty cycle of 100%, and the conduction duty cycle is reduced by the PI control as $T_{min}$ is closer to the start-up completion target temperature. In the timing of the temperature $T_{min}$ reaching the startup completion target temperature, the recording material P having the toner image thereon is conveyed, and the start-up sequence proceeds to a sheet passing sequence.

Meanwhile, in the PI control section S1001, power supply control to the heat generating block $HB_{other}$ other than the heat generating block $HB_{min}$ is carried out by the PI control so that the temperature $T_{other}$ of the heat generating block $HB_{other}$ is approximated to the temperature $T_{min}$ of the heat generating block $HB_{min}$. More specifically, the start-up control parameter according to the embodiment is a target temperature in the process of the start-up of the heat generating block $HB_{other}$, which is changed sequentially during the start-up control with reference to the temperature $T_{min}$ representing the start-up performance of the heat generating block $HB_{min}$. Immediately after the transition from the fixed duty cycle section S1000 to the PI control section S1001, the temperature $T_{other}$ is higher than the temperature $T_{min}$. However, the conduction duty cycle to the heat generating block $HB_{other}$ is thereafter reduced by the PI control, so that the heat generating block $HB_{other}$ can start up by a temperature transition similar to that in the heat generating block $HB_{min}$.

As in the foregoing, when the plurality of heat generating blocks $HB_i$ (i=1 to 7) have different maximum heat generating quantity, the temperatures of the heat generating blocks may be equalized before the start-up by the control according to the embodiment.

7. Advantageous Effects

Now, advantageous effects of the embodiment will be described with reference to a first comparative example.

In a start-up sequence according to the first comparative example, power is supplied to the heat generating blocks by the PI control so that the temperature of each of the heat generating block $HB_i$ (i=1 to 7) is approximated to the start-up completion target temperature. Therefore, a heat generating block having a small resistance value and a large heat generating quantity (hereinafter referred to as $HB_{other}$ according to the first comparative example) starts up earlier as indicated by the dash-dotted line in FIG. 6A and stands by for a transition to the sheet passing sequence while keeping the start-up completion target temperature. More specifically, the temperature transition according to the first comparative example varies among the heat generating blocks more greatly than the first embodiment.

In the start-up sequence, the heat generating blocks $HB_i$ (i=1 to 7) heat the heating regions $A_1$ to $A_7$, so that the fixing film 202 and the pressure roller 208 have increased temperatures. The heat generating block with early start-up as $HB_{other}$ according to the first comparative example is kept in a high temperature state for a longer period than a heat generating block with delayed start-up, and therefore the temperature of the part of the pressure roller 208 corresponding to the heat generating blocks is more easily raised. Therefore, with the variations in the temperature transition among the heat generating blocks as in the first comparative example, variations are likely to be generated in the temperature distribution of the pressure roller 208 after the start-up, and as a result, an image defect such as gloss value unevenness and hot offset may be generated.

In order to clearly demonstrate the effects, a comparison experiment was carried out as follows.

The fixing apparatuses 200 according to the first embodiment and the first comparative example were cooled to room temperature and then a half-tone image was printed on a sheet. The surface temperature of the pressure roller 208 immediately after the start-up was measured by thermography and the print of the half-tone image was observed for hot offset. Note that the same fixing apparatus 200 was used as the fixing apparatus 200 for the first embodiment and as the fixing apparatus 200 for the first comparative example simply by changing control software.

The result of the comparison experiment is given in FIG. 7. The surface temperature of the pressure roller 208 in a position corresponding to each of the heat generating blocks $HB_i$ (i=1 to 7) and the presence/absence of hot offset on the image are given in a table.

In the first comparative example, the surface temperature of the pressure roller 208 varied within the range of 6° C., and slight hot offset was generated in the position corresponding to the heat generating block $HB_5$ having the highest temperature. Meanwhile, according to the first embodiment, the surface temperature of the pressure roller 208 according to the first embodiment varied within 1° C., and there was no hot offset.

As described above, in the fixing apparatus which controls heating by a plurality of heat generating blocks independently for the purpose of power saving, the start-up control according to the first embodiment is carried out, so that heating unevenness in the start-up and an image defect immediately after the start-up were restrained.

8. Modification of First Embodiment

According to the embodiment, while the heat generating block $HB_{min}$ was determined using the temperature of the heat generating block $HB_i$ having been supplied with power for a prescribed period with a fixed duty cycle, the heat generating block $HB_{min}$ may be determined by a different method. For example, in the fixed duty cycle section S1000, the time period until a prescribed temperature is reached is measured, and the heat generating block with the longest time period may be determined as the heat generating block $HB_{min}$.

In the fixed duty cycle section S1000, the gradient of the temperature rise over time may be calculated, and the heat generating block with the smallest gradient may be determined as the heat generating block $HB_{min}$. The temperature rise for a prescribed time period or time required for a prescribed temperature rise may be measured to calculate the gradient of the temperature rise.

Power detecting means for detecting the power of the plurality of heat generating blocks (respective power consumption) may be provided, and the heat generating block with the smallest power in the fixed duty cycle section S1000 may be determined as the heat generating block $HB_{min}$.

The start-up performance information once obtained for each of the heat generating blocks $HB_i$ (the gradient of the temperature rise representing the percentage of the temperature rise while power is supplied, the power, etc.) may be stored, and the heat generating block $HB_{min}$ may be determined for the next printing operation on the basis of the stored start-up performance information. The heat generating block $HB_{min}$ may be stored and the information may be used for the next printing operation.

Alternatively, in the process of manufacturing the fixing apparatus 200, the start-up requirement time or information on the start-up requirement time may be measured, and the heat generating block $HB_{min}$ may be determined using the information. For example, when the fixing apparatus 200 is produced, the resistance values of the heat generating blocks are measured and stored by storage means provided at the fixing apparatus 200 or the image forming apparatus 100. Then, during the start-up operation of the fixing apparatus 200, the information stored in the storage means is read out, and the heat generating block with the lowest resistance value is determined as the heat generating block $HB_{min}$. Here, the storage means refers to anything capable of storing information such as a memory such as an NVRAM, an RFID such as an IC tag, and a barcode.

The heat generating block which requires the longest start-up time may be determined any of the methods, so that heating unevenness during the start-up can be restrained and an image defect immediately after the start-up can be restrained similarly to the first embodiment.

Second Embodiment

A second embodiment of the present invention will be described. The basic configuration and operation of an image forming apparatus and an image heating apparatus according to the second embodiment are the same as those of the first embodiment. Therefore, elements having functions and structures identical or corresponding to the first embodiment are designated by the same reference characters and their detailed description will not be repeated. The matters which will not be particularly described here in connection with the second embodiment are the same as those of the first embodiment. The second embodiment is different from the first embodiment in that the start-up control parameter (here, a target temperature for a heat generating block during the start-up) is changed according to a different reference. According to the first embodiment, the temperature $T_{min}$ is used as a reference, while according to the second embodiment, the start-up speed of the heat generating block $HB_{min}$ is used as a reference.

Figure 8:
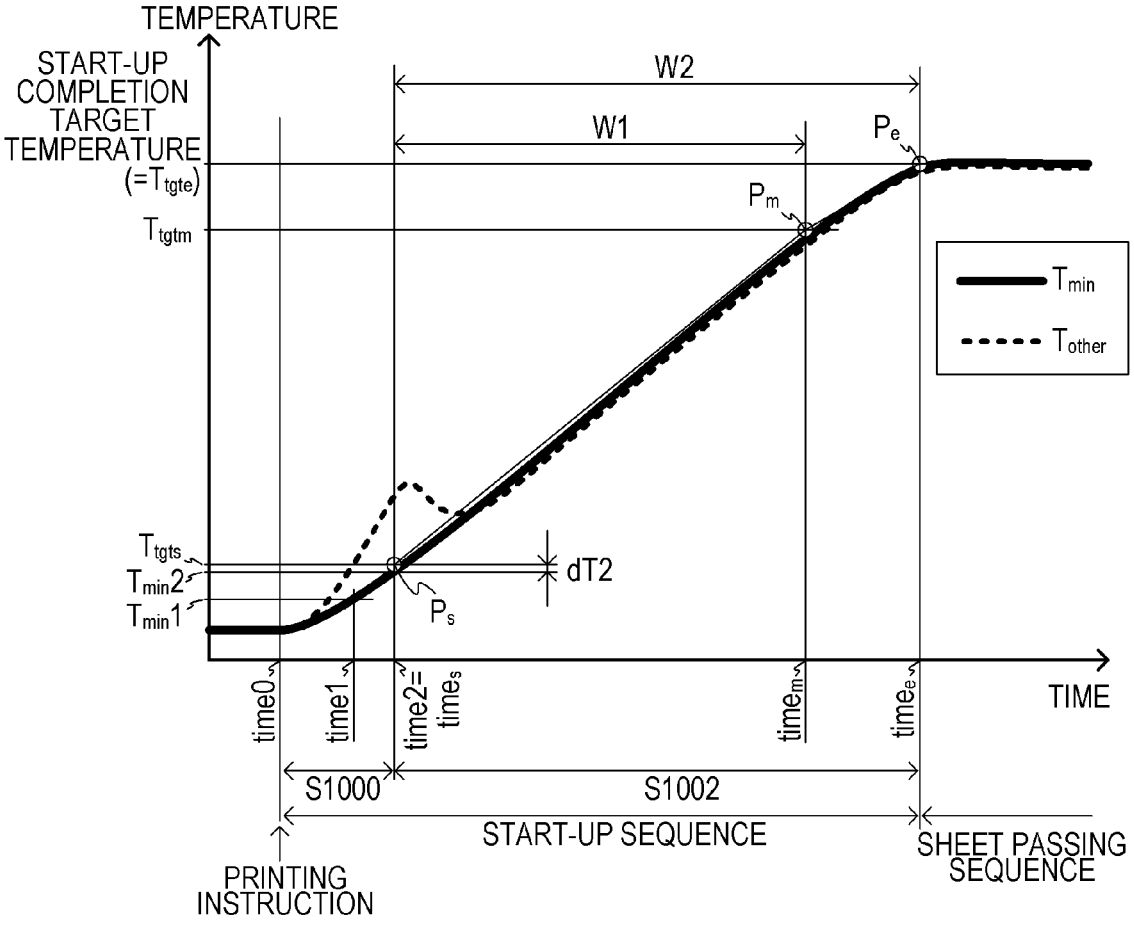
FIG. 8 is a graph for illustrating a start-up sequence according to a second embodiment of the invention.

With reference to FIG. 8, a method for controlling heating by the heater in a start-up sequence according to the second embodiment will be described. FIG. 8 shows an example of the transition of the temperature of a heat generating block detected by a thermistor TH and the transition of a target temperature. The start-up sequence according to the embodiment is divided into a section for supplying power with a fixed duty cycle (S1000) and a start-up section by PI control (S1002).

Similarly to the first embodiment, in the fixed duty cycle section S1000, the length of the time required for each of the heat generating blocks $HB_i$ (i=1 to 7) for the start-up is examined, and the heat generating block $HB_{min}$ which requires the longest start-up time is determined.

In the fixed duty cycle section S1000, the start-up speed $TRR_{min}$ (a temperature rise per unit time) is obtained for the heat generating block $HB_{min}$. The start-up speed $TRR_{min}$ is a value representing the start-up performance of the heat generating block $HB_{min}$ according to the embodiment. Here, the measurement starting time for the start-up speed $TRR_{min}$ is time 1, the measurement ending time is time 2, the temperature of the heat generating block $HB_{min}$ at time 1 is $T_{min}\mathbf{1}$, and the temperature of the heat generating block $HB_{min}$ at time 2 is $T_{min}\mathbf{2}$. In this case, the start-up speed of the heat generating block $HB_{min}$ is obtained as $TRR_{min}=(T_{min}\mathbf{2}-T_{min}\mathbf{1})/(\text{time } \mathbf{2}-\text{time } \mathbf{1})$. Immediately after the start of supply of power, the temperature rise is not stabilized, so that the start-up speed $TRR_{min}$ is desirably measured a prescribed time period after the start of supply of power. When the start-up speed $TRR_{min}$ of the heat generating block $HB_{min}$ is obtained, the start-up sequence proceeds to the PI control section S1002.

In the PI control section S1002, power supply control to the heat generating block $HB_{min}$ is carried out by the PI control so that the temperature $T_{min}$ of the heat generating block $HB_{min}$ is approximated to the start-up completion target temperature similarly to the first embodiment. Meanwhile, power supply control to the heat generating block $HB_{other}$ is carried out by the PI control so that the temperature $T_{other}$ is approximated to the start-up target temperature curve obtained as follows with reference to the start-up speed $TRR_{min}$.

The start-up target temperature curve is provided by obtaining the starting point $P_s$, the midpoint $P_m$, and the ending point $P_e$ as follows and connecting between the starting point $P_s$ and the midpoint $P_m$ and between the midpoint $P_m$ and the ending point $P_e$ by straight lines.

The $time_s$ at the starting point $P_s$ is time 2 ($time_s$=time 2). The target temperature $T_{tgts}$ at the starting point $P_s$ is obtained as $T_{tgts}=T_{min}\mathbf{2}+dT\mathbf{2}$. Here, dT2 is an offset temperature in consideration of delay time in the PI control. According to the embodiment, dT2=5° C. holds.

The target temperature $T_{tgte}$ at the ending point $P_e$ is the same temperature as the start-up completion target temperature. The $time_e$ at the ending point $P_e$ is obtained as $time_e=time_s+W\mathbf{2}$. W2 is obtained by adding the offset time dTime to the time required for the temperature rise from the temperature $T_{min}\mathbf{2}$ to the temperature $T_{tgte}$ at the fixed temperature rise speed $TRR_{min}$ and obtained as $W\mathbf{2}=(T_{tgte}-T_{min}\mathbf{2})/TRR_{min}+dTime$. The offset time dTime is set for the purpose of reducing overshoot and allowing the start-up completion target temperature to be stably reached, and dTime=0.2 sec holds according to the embodiment.

The time at the midpoint $P_m$ is obtained as $time_m=time_s+W\mathbf{1}$ when $W\mathbf{1}=W\mathbf{2}\times 0.8$. The target temperature $T_{tgtm}$ at the midpoint $P_m$ is obtained as a temperature raised for time W1 at the fixed temperature rise speed $TRR_{min}$ from the temperature $T_{tgts}$, and $T_{tgtm}=TRR_{min}\times W\mathbf{1}+T_{tgts}$ holds.

As in the foregoing, the start-up target temperature curve obtained with reference to the start-up speed $TRR_{min}$ of the heat generating block $HB_{min}$ indicates a transition substantially the same as the temperature $T_{min}$ of the heat generating block $HB_{min}$. Therefore, the PI control is carried out so that the temperature $T_{other}$ of the heat generating block $HB_{other}$ is approximated to the temperature start-up target temperature curve, and the start-up can be carried out while the temperatures of the heat generating blocks are equal, so that the same advantageous effects as those of the first embodiment can be provided.

Third Embodiment

A third embodiment of the present invention will be described. The basic configuration and operation of an image forming apparatus and an image heating apparatus according to the third embodiment are the same as those of the first embodiment. Therefore, elements having functions and structures identical to or corresponding to those of the first embodiment are designated by the same reference characters and their detailed description will not be repeated. The matters which will not be particularly described here in connection with the third embodiment are the same as those of the first embodiment. According to the third embodiment, the start-up control parameter is a conduction duty cycle for the heat generating block $HB_{other}$, and the conduction duty cycle is changed so that the input power to the heat generating blocks $HB_i$ is equal by changing the conduction duty cycle, which is different from the first embodiment.

The start-up sequence according to the embodiment is divided into a section for supplying power with an equal fixed duty cycle (S1000) to all the heat generating blocks $HB_i$ (i=1 to 7) and a start-up section (S1003 which corresponds to S1001 according to the first embodiment) by the PI control.

In the fixed duty cycle section S1000, the heat generating blocks $HB_i$ are supplied with power with a duty cycle of 100%, and power $W_{100i}$ (i=1 to 7) is calculated for each of the heat generating blocks $HB_i$ at the time. The power $W_{100i}$ is in other words power which can be input to each of the heat generating blocks $HB_i$. According to the embodiment, power detecting means for detecting the power of the heat generating blocks is provided, and the power $W_{100i}$ a prescribed time period after the start of supply of power is directly measured. When the power $W_{100i}$ with a duty cycle of 100% is obtained per heat generating block $HB_i$, the start-up sequence proceeds to the PI control section S1003.

In the PI control section S1003, the power supply control to the heat generating blocks $HB_i$ is carried out by the PI control so that the temperature $T_i$ of the heat generating block $HB_i$ is approximated to the start-up completion target temperature. Note however that a duty cycle $Pdh_i$ for actually supplying power to the heat generating block $HB_i$ is obtained as $Pdh_i=Pd_i\times K_i$ when a conduction duty cycle calculated by the PI control for each of the heat generating blocks $HB_i$ is represented as $Pd_i$ ($0\leq Pd_i\leq 100$ where i=1 to 7). Here, $K_i$ is a correction coefficient obtained as $K_i=W_{100min}/W_{100i}$. $W_{100min}$ is a value representing the start-up performance of the heat generating block $HB_{min}$ according to the embodiment and indicates the smallest power among power $W_{100i}$ (i=1 to 7) or power with a conduction duty cycle of 100% in the heat generating block $HB_{min}$ which requires the longest start-up time.

As in the foregoing, the conduction duty cycle $Pdh_i$ is changed with reference to the power $W_{100min}$ with the conduction duty cycle of 100% in the heat generating block $HB_{min}$, and therefore input power can be equalized if the resistance values of the heat generating blocks $HB_i$ vary among the heat generating blocks $HB_i$. As a result, the same advantageous effects as those of the first embodiment can be provided.

Fourth Embodiment

A fourth embodiment of the present invention will be described. The basic configuration and operation of an image forming apparatus and an image heating apparatus according to the fourth embodiment are the same as those of the first embodiment. Therefore, elements having functions and structures identical to or corresponding to those of the first embodiment are designated by the same reference characters and their detailed description will not be repeated. The matters which will not be particularly described here in connection with the fourth embodiment are the same as those of the first embodiment. The fourth embodiment is different from the first embodiment in that power to be input to the heat generating blocks $HB_{other}$ is a start-up control parameter, and power to be input to the heat generating blocks $HB_i$ is adjusted to be equal.

The start-up sequence according to the embodiment is divided into a section for supplying power with an equal fixed duty cycle (S1000) to all the heat generating blocks $HB_i$ (i=1 to 7) and a start-up section (S1004 which corresponds to S1001 according to the first embodiment) by the PI control.

The operation of the fixed duty cycle section S1000 is the same as that of the first embodiment and will not be described. When the heat generating block $HB_{min}$ which requires the longest start-up time is determined, the start-up sequence proceeds to the PI control section S1004.

In the PI control section S1004, power $W_{ti}$ (i=1 to 7) for each of the heat generating blocks $HB_i$ is sequentially calculated. According to the embodiment, power detecting means for detecting the power of each of the heat generating blocks is provided, and the power $W_{ti}$ is directly measured.

In the PI control section S1004, power supply control to the heat generating block $HB_{min}$ is carried out by the PI control so that the temperature $T_{min}$ of the heat generating block $HB_{min}$ is approximated to the completion target temperature. Meanwhile, supply of power to the heat generating blocks $HB_{other}$ is controlled so that the power $W_{tother}$ during the start-up in the heat generating blocks $HB_{other}$ is approximated to $W_{tmin}$. Here, $W_{tmin}$ is power in the process of the start-up of the heat generating block $HB_{min}$ and a value representing the start-up performance of the heat generating block $HB_{min}$ according to the embodiment.

As in the foregoing, the power $W_{tother}$ to be input to the heat generating blocks $HB_{other}$ is changed with reference to the power $W_{tmin}$ in the process of the start-up in the heat generating block $HB_{min}$. In this way, input power during the start-up can be equalized if the resistance value varies among the heat generating blocks $HB_i$. As a result, the heat generating blocks $HB_i$ can start up at the same temperature, so that the same advantageous effects as those of the first embodiment can be provided.

Fifth Embodiment

A fifth embodiment of the present invention will be described. The basic configuration and operation of an image forming apparatus and an image heating apparatus according to the fifth embodiment are the same as those of the first embodiment. Therefore, elements having functions and structures identical or corresponding to those of the first embodiment are designated by the same reference characters and their detailed description will not be repeated. The matters which will not be particularly described here in connection with the fifth embodiment are the same as those of the first embodiment. The fifth embodiment is different from the first embodiment in that the starting timing for start-up is a start-up control parameter.

Figure 9:
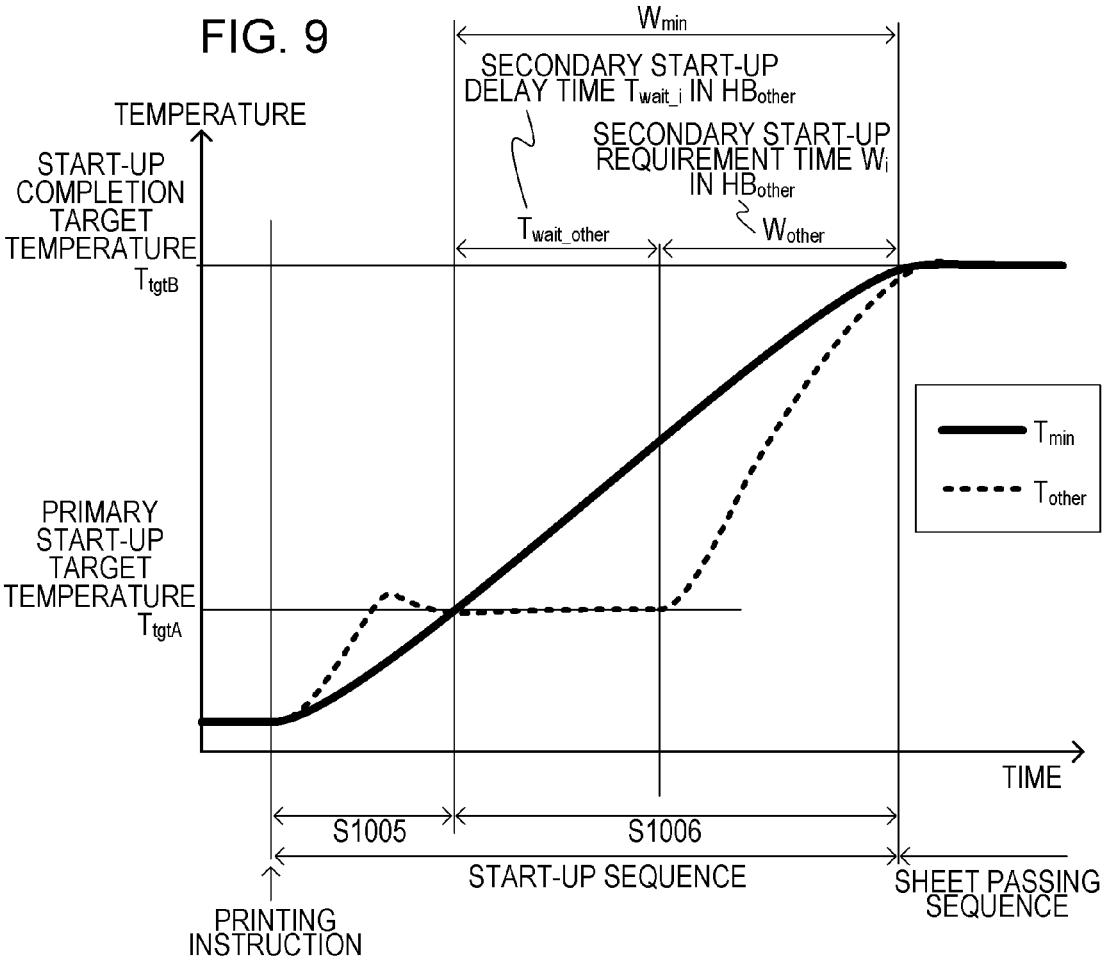
FIG. 9 is a graph for illustrating a start-up sequence according to a fifth embodiment of the invention.

With reference to FIG. 9, a method for controlling heating by a heater in a start-up sequence according to the fifth embodiment will be described. FIG. 9 shows an example of the transition of the temperatures of heat generating blocks detected by thermistors TH.

The start-up sequence according to the embodiment may be divided into a primary start-up section S1005 for raising the temperature of the heat generating block $HB_i$ (i=1 to 7) to a primary start-up target temperature and a secondary start-up section S1006 for raising the primary start-up target temperature to a start-up completion target temperature.

In the primary start-up section S1005, power is supplied with a duty cycle of 100% to the heat generating blocks $HB_i$ to start with. According to the embodiment, a prescribed primary start-up target temperature $T_{tgtA}$ is set to a lower temperature than a start-up completion target temperature $T_{tgtB}$. In a heat generating block $HB_i$ for which a temperature detected by the thermistor TH reaches the primary start-up target temperature $T_{tgtA}$, the method for supplying power is switched to the PI control based method targeted to the temperature $T_{tgtA}$. While power is supplied with a duty cycle of 100%, the start-up speed $TRR_i$ of each of the heat generating blocks $HB_i$ (the temperature rise amount per unit time) is obtained. Immediately after the power starts to be supplied, the temperature rise amount is not stable, and therefore the start-up speed $TRR_i$ is desirably measured a prescribed time period after the start of supply of power. When all the heat generating blocks $HB_i$ attain the primary start-up target temperature $T_{tgtA}$, the start-up sequence proceeds to the secondary start-up section S1006.

In the secondary start-up section S1006, the power supply control to the heat generating blocks $HB_i$ is carried out by the PI control so that the temperature $T_i$ of the heat generating block $HB_i$ is approximated to the start-up completion target temperature $T_{tgtB}$. Note however that secondary start-up delay time $T_{wait_i}$ (i=1 to 7) per heat generating block $HB_i$ is calculated in advance according to a method which will be described. For the secondary start-up delay time $T_{wait_i}$ after the switch to the secondary start-up section S1006, the primary start-up target temperature $T_{tgtA}$ continues to be the target temperature.

The secondary start-up delay time $T_{wait_i}$ is calculated as follows. A secondary start-up requirement time $W_i$ (i=1 to 7) for each of the heat generating blocks $HB_i$ is calculated as $W_i=(T_{tgtB}-T_{tgtA})/TRR_i$ from the start-up speed $TRR_i$, the primary start-up target temperature $T_{tgtA}$, and the start-up completion target temperature $T_{tgtB}$. Among the secondary start-up requirement time $W_i$, the longest one is represented by $W_{min}$. $W_{min}$ represents the secondary start-up requirement time for the heat generating block $HB_{min}$ which requires the longest start-up time and a value representing the start-up performance of the heat generating block $HB_{min}$. The secondary start-up delay time $T_{wait_i}$ per heat generating block $HB_i$ is calculated as $T_{wait_i}=W_{min}-W_i$. Note that the secondary start-up delay time $T_{wait_min}$ of the heat generating block $HB_{min}$ which requires the longest start-up time is zero ($T_{wait_min}=0$).

As in the foregoing, according to the embodiment, the difference between the secondary start-up requirement time $W_{min}$ of the heat generating block $HB_{min}$ as a reference and the secondary start-up requirement time for the heat generating block $HB_{other}$ (i.e., the secondary start-up delay time $T_{wait_i}$) is obtained. Then, the timing for starting raising the temperature in the secondary start-up section S1006 is changed. Since all the heat generating blocks $HB_i$ start up to attain the start-up completion target temperature $T_{tgtB}$ almost at a time, variations in the temperature distribution of the pressure roller 208 can be restrained as compared to the first comparative example. As a result, an image defect such as gloss value unevenness and hot offset may be reduced.

Note that according to the embodiment, the secondary start-up requirement time $W_i$ for each of the heat generating blocks $HB_i$ is obtained from the start-up speed $TRR_i$ of each of the heat generating block $HB_i$, while the secondary start-up requirement time $W_i$ may be obtained by any other method. For example, if the relation between the power and the start-up speed is examined in advance, the start-up speed may be estimated from the power. Then, the power supply voltage is measured at the start of the start-up sequence, and power is calculated using the result and the previously calculated resistance value of each of the heat generating blocks, so that the secondary start-up requirement time $W_i$ can be calculated. In this case, the secondary start-up requirement time $W_i$ is already known at the initial point of the start-up sequence, and therefore the primary start-up section S1005 may be omitted.

Sixth Embodiment

A sixth embodiment of the present invention will be described. The basic configuration and operation of an image forming apparatus and an image heating apparatus according to the sixth embodiment are the same as those of the fifth embodiment. Therefore, elements having functions and structures identical or corresponding to those of the fifth embodiment are designated by the same reference characters and their detailed description will not be repeated. The matters which will not be particularly described here in connection with the sixth embodiment are the same as those of the fifth embodiment. The sixth embodiment is different from the fifth embodiment in that the primary start-up target temperature is changed for each of the heat generating blocks.

Figure 10:
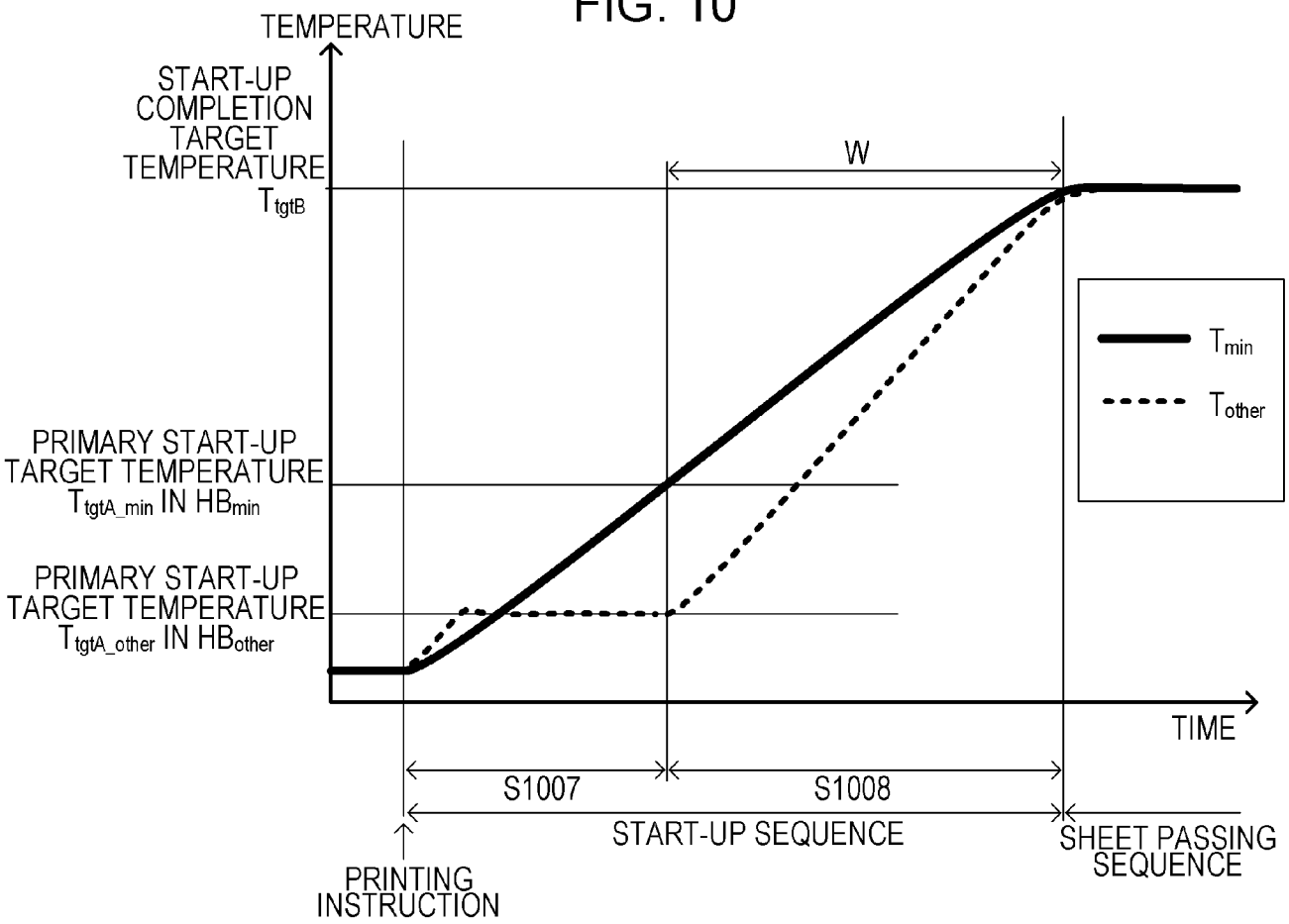
FIG. 10 is a graph for illustrating a start-up sequence according to a sixth embodiment of the invention.

With reference to FIG. 10, a method for controlling heating by the heater in a start-up sequence according to the sixth embodiment will be described. FIG. 10 shown an example of the transition of the temperature of the heat generating blocks detected by thermistors TH.

The start-up sequence according to the embodiment is divided into a primary start-up section S1007 in which the heat generating block $HB_i$ (i=1 to 7) starts up to a primary target temperature and a secondary start-up section S1008 in which the target temperature is raised from the primary start-up target temperature to a start-up completion target temperature.

In the primary start-up section S1007, power starts to be supplied with a duty cycle of 100% to the heat generating blocks $HB_i$ and the start-up speed $TRR_i$ of each of the heat generating blocks $HB_i$ is obtained similarly to the second embodiment. Then, a prescribed primary start-up target temperature $T_{tgtA_i}$ is calculated as $T_{tgtA_i}=T_{tgtB}-TRR_i\times W$ from the start-up completion target temperature $T_{tgtB}$ and the secondary start-up time W, which will be described, on the basis of the start-up speed $TRR_i$. The method for supplying power to a heat generating block $HB_i$ for which a temperature detected by the thermistor TH reaches the primary start-up target temperature $T_{tgtA_i}$ is sequentially switched to the PI control targeted to the target temperature $T_{tgtA_i}$.

After all the heat generating blocks $HB_i$ attain the primary start-up target temperature $T_{tgtA_i}$, the start-up sequence proceeds to the secondary start-up section S1008. More specifically, the start-up speed of the heat generating block $HB_{min}$ which requires the longest start-up time is represented by $TRR_{min}$, and the primary start-up target temperature is represented by $T_{tgtA_min}$. In this case, transition timing to the secondary start-up section changes according $T_{tgtA_min}$ calculated on the basis of $TRR_{min}$.

In the secondary start-up section S1008, the power supply control to each of the heat generating blocks $HB_i$ is carried out by the PI control so that the temperature $T_i$ of the heat generating block $HB_i$ is approximated to a start-up completion target temperature $T_{tgtB}$. The secondary start-up time W is the time length of the secondary start-up section S1008 and set to the same value as the time for an electrostatic latent image formed on the photosensitive drum 19 to reach the heating region $A_i$ (i=1 to 7) of the fixing apparatus 200 according to the embodiment. More specifically, the start-up sequence is switched from the primary start-up section S1007 to the secondary start-up section S1008, and at the same time, the electrostatic latent image starts to form on the photosensitive drum 19.

According to the embodiment, the primary start-up target temperature $T_{tgtA_i}$ is changed with reference to the start-up speed $TRR_i$ of each of the heat generating blocks $HB_i$. At the same time, the switching timing to the secondary start-up section S1006 is changed with reference to the start-up speed $TRR_{min}$ of the heat generating block $HB_{min}$ which requires the longest start-up time. The control allows all the heat generating blocks $HB_i$ to start up to attain the start-up completion target temperature $T_{tgtB}$ almost at a time, so that variations in the temperature distribution of the pressure roller 208 can be reduced as compared to the first comparative example. As a result, an image defect such as gloss value unevenness and hot offset can be reduced.

Seventh Embodiment

The case in which the leading end position of a toner image on the recording material P is different for each of the heating regions $A_i$ will be described as a seventh embodiment with reference to FIGS. 11A to 11C. The basic configuration and operation of an image forming apparatus and an image heating apparatus according to the seventh embodiment are the same as those of the fifth embodiment. Therefore, elements having functions and structures identical or corresponding to those of the fifth embodiment are designated by the same reference characters and their detailed description will not be repeated. The matters which will not be particularly described here in connection with the seventh embodiment are the same as those of the fifth embodiment.

Figure 11A:
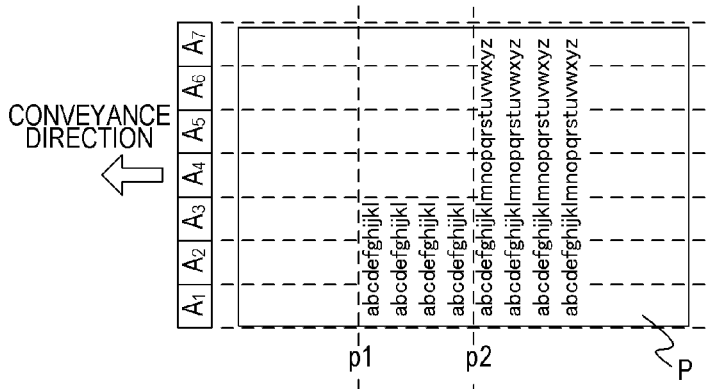
FIGS. 11A to 11C are a view and graphs for illustrating a start-up sequence according to a seventh embodiment of the invention.

FIG. 11A is a view showing the positional relation between an image to be printed and the heating regions $A_i$ according to the embodiment. The leading end position of the image with respect to the heating regions $A_1$, $A_2$, and $A_3$ is designated by p1 and the leading end position of the image with respect to the heating regions $A_4$, $A_5$, $A_6$, and $A_7$ is designated by p2 which is positioned behind p1. According to the embodiment, the start-up of the heat generating blocks $HB_i$ is adjusted so that the start-up completion target temperature $T_{tgtB}$ is reached in timing with the arrival of the leading end position of the image at the fixing nip N. More specifically, the start-up completion timing for the heat generating blocks $HB_4$, $HB_5$, $HB_6$, and $HB_7$ for which the image leading end position is p2 is later than the start-up completion timing for the heat generating blocks $HB_1$, $HB_2$, and $HB_3$ for which the image leading end position is p1.

Hereinafter, the heat generating blocks for which the image leading end position is ($HB_1$, $HB_2$, and $HB_3$ according to the embodiment) among the heat generating blocks $HB_i$ are referred to as a group A. The heat generating blocks other than the group A ($HB_4$, $HB_5$, $HB_6$, and $HB_7$ according to the embodiment) are referred to as a group B.

Figure 11B:
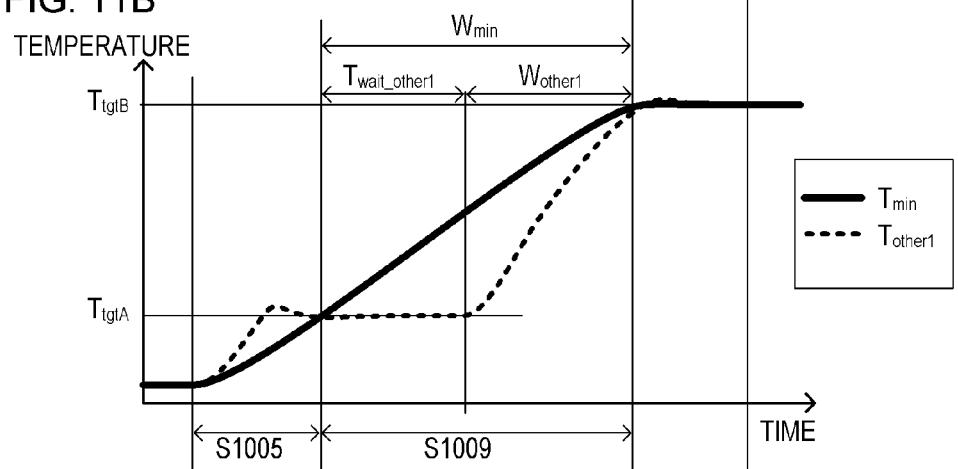

FIG. 11B is a graph showing temperature transition at the start-up of the heat generating blocks which belong to the group A. The temperature $T_{min}$ of the heat generating block $HB_{min}$ which requires the longest start-up time in the group A is indicated by the solid line, and the temperature $T_{other1}$ of the heat generating blocks collectively represented by $HB_{other1}$ other than the heat generating block $HB_{min}$ is indicated by the dotted line.

Figure 11C:
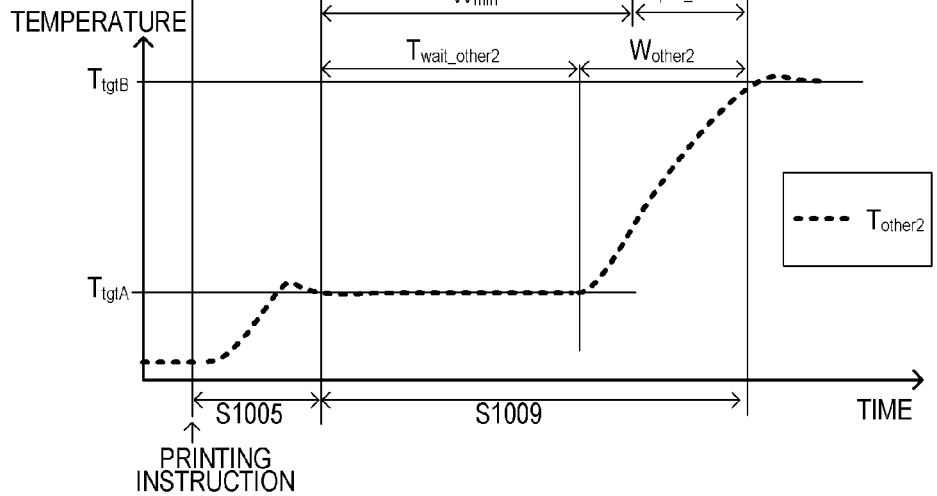

FIG. 11C is a graph showing temperature transition at the start-up of heat generating blocks which belong to the group B. The temperature $T_{other2}$ of the plurality of heat generating blocks collectively represented by $HB_{other2}$ is indicated by the dotted line.

The start-up sequence according to the embodiment is divided into a primary start-up section S1005 for raising the temperature of the heat generating block $HB_i$ (i=1 to 7) to a primary target temperature and a secondary start-up section S1009 for raising the primary start-up target temperature to the start-up completion target temperature.

The primary start-up section S1005 is the same as that according to the fifth embodiment and therefore will be not described. After all the heat generating blocks $HB_i$ attain a prescribed primary start-up target temperature $T_{tgtA}$, the start-up sequence proceeds to the secondary start-up section S1009.

In the secondary start-up section S1009, power supply control to each of the heat generating blocks $HB_i$ is carried out by the PI control so that the temperature $T_i$ of the heat generating block $HB_i$ is approximated to the start-up completion target temperature $T_{tgtB}$. Note that secondary start-up delay time $T_{wait_t}$ (i=1 to 7) is calculated in advance for each of the heat generating blocks $HB_i$ by a method which will be described. During the period of the secondary start-up delay time $T_{wait_i}$ after switching to the secondary start-up section S1009, the target temperature continues to be the primary start-up target temperature $T_{tgtA}$.

The secondary start-up delay time $T_{wait_i}$ is calculated as follows.

To start with, the secondary start-up requirement time $W_i$ (i=1 to 7) for each of the heat generating blocks $HB_i$ is calculated as $W_i=(T_{tgtB}-T_{tgtA})/TRR_i$ from the start-up speed $TRR_i$, the primary start-up target temperature $T_{tgtA}$, and the start-up completion target temperature $T_{tgtB}$. Among the secondary start-up requirement time $W_i$, the longest one is represented by $W_{min}$. $W_{min}$ represents the secondary start-up requirement time for the heat generating block $HB_{min}$ which requires the longest start-up time and a value representing the start-up performance of the heat generating block $HB_{min}$ according to the embodiment. In the figure, the secondary start-up requirement time $W_i$ for the heat generating block $HB_{other1}$ is indicated by $W_{other1}$. The secondary start-up requirement time $W_i$ for the heat generating block $HB_{other2}$ is indicated by $W_{other2}$.

The secondary start-up delay time $T_{wait_i}$ for each of the heat generating blocks $HB_i$ is calculated as $T_{wait_i}=n+T_{pos_i})-W_i$. Here, $T_{pos_i}$ is delay time related to the image tip end position and corresponds to a period after the image leading end position of the group A reaches the fixing nip N until the image leading end position corresponding to each of the heat generating blocks $HB_i$ reaches the fixing nip N. In the figure, the secondary start-up delay time $T_{wait_i}$ for the heat generating block $HB_{other1}$ is indicated by $T_{wait_other1}$. The secondary start-up delay time $T_{wait_i}$ for the heat generating block $HB_{other2}$ is indicated by $T_{wait_other2}$.

As in the foregoing, according to the embodiment, the start-up control is carried out in consideration of the image leading end position, so that unnecessary heating before the arrival of the image can be reduced. As a result, an image defect such as gloss value unevenness and hot offsets can be reduced.

Other Embodiments

1. When Start-Up Completion Target Temperature and Pre-Start-Up Temperature are not Uniform In the description of the first to sixth embodiments, the plurality of heat generating blocks $HB_i$ (i=1 to 7) are identical, while the start-up completion target temperature may be different among the heat generating blocks $HB_i$ in actual image printing. For example, an image with a low print percentage such as a half-tone image requires a higher heat value for fixing as compared to an image with a high print percentage such as a solid image. Therefore, the target temperature for the heat generating block $HB_i$ for heating the heating region $A_i$ corresponding to a low print percentage image is set to a higher value. In this way, when the start-up completion target temperature is different among the heat generating blocks $HB_i$, the present invention may be applied by carrying out correction control corresponding to the start-up completion target temperature, and the advantageous effects can be provided. For example, when the start-up completion target temperature is low, only a small heat value is necessary for the start-up, and the target temperature can be reached more quickly. Therefore, when the length of the start-up requirement time is determined, correction can be carried out so that estimated start-up requirement time is smaller for a heat generating block $HB_i$ with a lower start-up completion target temperature.

The temperature before the start-up can be different among the heat generating blocks $HB_i$ depending on the printing history. A warm heat generating block $HB_i$ to start with can attain a target temperature with a smaller heat value and more quickly. Therefore, when the length of the start-up requirement time is determined, correction can be carried out so that estimated start-up requirement time is smaller for a heat generating block $HB_i$ having a higher pre-start-up temperature.

Hereinafter, an example of correction control carried out when the pre-start-up temperature for each of the heat generating blocks $HB_i$ is $T_{tgtA_i}$ (i=1 to 7) and the completion target temperature for each of the heat generating blocks $HB_i$ is $T_{tgtB_i}$ (i=1 to 7) will be described. Similarly to the second embodiment, while power is supplied with a duty cycle of 100%, the start-up speed $TRR_i$ of each of the heat generating blocks $HB_i$ (a temperature rise per unit time) is obtained. Then, the start-up requirement time $W_i$ (i=1 to 7) for each of the heat generating block $HB_i$ is obtained as $W_i=(T_{tgtB_i}-T_{tgtA_i})/TRR_i$ from the start-up speed $TRR_i$, the pre-start-up temperature $T_{tgtA_i}$, and the start-up completion target temperature $T_{tgtB_i}$. The start-up requirement time $W_i$ is calculated by the above method, and estimated start-up requirement time $W_i$ may be smaller for a higher pre-start-up temperature $T_{tgtA_i}$ and the estimated start-up requirement time $W_i$ may be smaller for a lower start-up completion target temperature $T_{tgtB_i}$.

2. When Heat Generating Blocks have Unequal Length

In the above description of the embodiments, the heating regions A, and the heat generating blocks $HB_i$ are obtained by division into seven equal parts as for the number of divisions and the dividing positions by way of illustration, while the advantageous effects of the invention may be provided by any of other configurations. For example, dividing positions may correspond to the ends of the width of a regular size sheet such as a JIS B5 sheet (182 mm×257 mm) and an A5 sheet (148 mm×210 mm). In this case, the heat generating blocks $HB_i$ may have different lengths depending on the dividing positions. When the heat generating blocks having different lengths are heated by the same power, a shorter heat generating block $HB_i$ has a greater heat generating quantity per unit length and the start-up occurs earlier. Therefore, the word "power" used in connection with determination of the start-up requirement time, the start-up performance, and the start-up control parameter can be replaced by "power per unit length," so that the heat generating quantity can be equal.

3. When Some of Heat Generating Blocks $HB_i$ are not Independent

In the above description of the embodiments, the heat generating blocks $HB_i$ are independently controlled in relation with heating, while some of the heat generating blocks $HB_i$ may be subjected to common control or dependent control. In this case, the heat generating blocks under the common control or dependent control are classified as a group (hereinafter referred to as a non-independent group). The average or lowest value of a parameter representing the start-up performance of the heat generating blocks in the non-independent group is obtained and set as a reprehensive value for the non-independent group. Here, the parameter representing the start-up performance is a numerical value such as the power $W_{100i}$ with a conduction duty cycle of 100%, the start-up requirement time $W_i$, and the start-up speed $TRR_i$ on the basis of which the length of the start-up requirement time can be determined. The representative value of the non-independent group is compared to a parameter representing the start-up performance of an independently controllable heat generating block, and the length of the start-up requirement time is determined. As a result, if it is determined that the non-independent group includes the heat generating block which requires the longest start-up time, the start-up control parameter of each of the heat generating block $HB_i$ may be adjusted with reference to the representative value for the start-up performance of the non-independent group. The same applies to the case in which a plurality of such non-independent groups are provided.

The above-described embodiments may have their features combined as in many ways as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-011778, filed on Jan. 26, 2018, which is hereby incorporated by reference herein in its entirety.

What is claimed is:

1. An image heating apparatus comprising:

an image heating portion having a heater having a substrate and a plurality of heat generating elements arranged on the substrate in a lengthwise direction of the substrate, the image heating portion heating an image formed on a recording material using heat from the heater;

a power supply control portion which controls power to be supplied to the plurality of heat generating elements independently from one another; and an acquiring portion which acquires, for each of the plurality of heat generating elements, start-up performance representing a gradient of a temperature rise when power is supplied thereto, wherein, in a start-up sequence for raising temperatures of the plurality of heat generating elements to respective prescribed target temperatures, the power supply control portion controls power to be supplied to the plurality of heat generating elements independently from one another on the basis of the start-up performance acquired by the acquiring portion so that gradients of a temperature rise of each of the plurality of heat generating elements become similar to each other and the plurality of heat generating elements attain the prescribed target temperatures in the same timing.

2. The image heating apparatus according to claim 1, wherein the power supply control portion controls power to be supplied to the plurality of heat generating elements by setting a start-up target temperature, which is sequentially changed during the start-up performance, and which is set before the prescribed target temperature is reached, to the same temperature for the plurality of heat generating elements.

3. The image heating apparatus according to claim 1, wherein the acquiring portion has a power detecting portion for detecting power consumed by each of the plurality of heat generating elements, and the acquiring portion acquires the start-up performance on the basis of the power detected by the power detecting portion while the power supply control portion supplies power to each of the plurality of heat generating elements with a fixed duty cycle.

4. The image heating apparatus according to claim 1, wherein the power supply control portion controls power to be supplied to first and second heat generating elements independently from each other so that the first heat generating element attains the prescribed target temperature in the same timing as timing in which the second heat generating element attains the prescribed target temperature, the second heat generating element having the lowest start-up performance among the plurality of heat generating elements, and the first heat generating element having higher start-up performance than that of the second heat generating element.

5. The image heating apparatus according to claim 4, wherein the acquiring portion acquires a temperature rise amount per unit time of the second heat generating element, and wherein the power supply control portion controls power to be supplied to the first and second heat generating elements independently from each other so that the first heat generating element is raised in temperature with the same temperature rise amount per unit time as that of the second heat generating element.

6. The image heating apparatus according to claim 4, wherein the power supply control portion sets a start-up target temperature, which is sequentially changed during the start-up performance before the prescribed target temperature is reached in the control of power supply to the first heat generating element to the same temperature as a start-up target temperature, which is sequentially changed during the start-up performance before the prescribed target temperature is reached in the control of power supply to the second heat generating element.

7. The image heating apparatus according to claim 4, wherein the power supply control portion adjusts a conduction duty cycle with respect to the second heat generating element so that the second heat generating element attains the prescribed target temperature in the same timing as timing in which the first heat generating element attains the prescribed target temperature.

8. The image heating apparatus according to claim 4, wherein the acquiring portion has a power detecting portion for detecting power consumed by each of the first and second heat generating elements, and wherein the power supply control portion controls power to be supplied to the first and second heat generating elements on the basis of the power detected by the power detecting portion so that an amount of power consumed by the second heat generating element is the same as an amount of power consumed by the first heat generating element.

9. The image heating apparatus according to claim 1, further comprising a tubular film configured to rotate while an inner surface thereof is in contact with the heater, wherein an image on a recording material is heated through the film.

10. An image forming apparatus comprising:

an image forming portion which forms an image on a recording material; and the image heating apparatus according to claim 1 as a fixing portion which fixes the image formed on the recording material to the recording material.

11. An image heating apparatus comprising:

an image heating portion having a heater having a substrate and a plurality of heat generating elements arranged on the substrate in a lengthwise direction of the substrate, the image heating portion heating an image formed on a recording material using heat from the heater;

a power supply control portion which controls power to be supplied to the plurality of heat generating elements independently from one another; and an acquiring portion which acquires, for each of the plurality of heat generating elements, start-up performance representing a gradient of a temperature rise when power is supplied thereto, wherein, in a start-up sequence for raising temperatures of the plurality of heat generating elements to respective prescribed target temperatures, the power supply control portion controls power to be supplied to the plurality of heat generating elements independently from one another on the basis of the start-up performance acquired by the acquiring portion so that the plurality of heat generating elements attain the prescribed target temperatures in the same timing, wherein the plurality of heat generating elements includes a first heat generating element and a second heat generating element, wherein the second heat generating element having the lowest start-up performance among the plurality of heat generating elements, and the first heat generating element having higher start-up performance than that of the second heat generating element, and wherein the power supply control portion delays timing for raising a temperature of the first heat generating element from timing for raising a temperature of the second heat generating element, so that the first heat generating element attains the prescribed target temperature in the same timing as timing in which the second heat generating element attains the prescribed target temperature.

12. The image heating apparatus according to claim 11, wherein in the control of power supply to the plurality of heat generating elements, there are a primary start-up section for raising the temperature of the heat generating elements to a first target temperature lower than the prescribed target temperature and a secondary start-up section for raising the temperature of the heat generating elements from the first target temperature to the prescribed target temperature, and the power supply control portion delays timing for starting the second start-up section in the control of power supply to the first heat generating element from timing for starting the secondary start-up section in the control of power supply to the second heat generating element.

13. The image heating apparatus according to claim 11, wherein in the control of power supply to the plurality of heat generating elements, there are a primary start-up section for raising the temperature of the heat generating elements to a first target temperature lower than the prescribed target temperature and a secondary start-up section for raising the temperature of the heat generating elements from the first target temperature to the prescribed target temperature, and the power supply control portion sets the first target temperature for each of the plurality of heat generating elements.

14. The image heating apparatus according to claim 11, wherein the power supply control portion sets, independently from each other, a start-up target temperature, which is sequentially changed during the start-up performance that is a temperature before the prescribed temperature is reached and is set in the control of power supply to the first heat generating element and a start-up target temperature, which is sequentially changed during the start-up performance that is a temperature before the prescribed target temperature is reached and is set in the control of power supply to the second heat generating element.

15. The image heating apparatus according to claim 11, further comprising a tubular film configured to rotate while an inner surface thereof is in contact with the heater, wherein an image on a recording material is heated through the film.

16. An image forming apparatus comprising:

an image forming portion which forms an image on a recording material; and the image heating apparatus according to claim 11 as a fixing portion which fixes the image formed on the recording material to the recording material.

* * * * *